US008017233B2

(12) United States Patent
Miyazono et al.

(10) Patent No.: US 8,017,233 B2
(45) Date of Patent: Sep. 13, 2011

(54) FIBERS HAVING EXCELLENT RESPONSIVENESS TO MAGNETIC FIELDS AND EXCELLENT CONDUCTIVITY, AS WELL AS ARTICLES MADE OF THE SAME

(75) Inventors: Kouki Miyazono, Mishima (JP); Yuhei Maeda, Yokohama (JP)

(73) Assignee: Toray Industries, Inc. (JP)

( * ) Notice: Subject to any disclaimer, the term of this patent is extended or adjusted under 35 U.S.C. 154(b) by 1703 days.

(21) Appl. No.: 10/556,545

(22) PCT Filed: May 18, 2004

(86) PCT No.: PCT/JP2004/007055

§ 371 (c)(1),
(2), (4) Date: Nov. 14, 2005

(87) PCT Pub. No.: WO2004/101871

PCT Pub. Date: Nov. 25, 2004

(65) Prior Publication Data

US 2007/0003761 A1 Jan. 4, 2007

(30) Foreign Application Priority Data

May 19, 2003 (JP) ..... 2003-140017
Feb. 24, 2004 (JP) ..... 2004-047737

(51) Int. Cl.
*D02G 3/00* (2006.01)

(52) U.S. Cl. ..... 428/372; 428/375

(58) Field of Classification Search ..... None
See application file for complete search history.

(56) References Cited

U.S. PATENT DOCUMENTS 3,014,818 A * 12/1961 Campbell ..... 428/549
3,691,993 A * 9/1972 Krause et al. ..... 118/638
3,803,453 A * 4/1974 Hull ..... 361/220
4,420,534 A * 12/1983 Matsui et al. ..... 428/372
4,835,807 A * 6/1989 Swift ..... 15/1.51
5,744,090 A 4/1998 Jones et al.

FOREIGN PATENT DOCUMENTS

JP 57-167416 A * 10/1982
JP 59-173312 A * 10/1984
JP 2-193176 A * 7/1990
JP 2-193180 A * 7/1990
JP 02-264013 * 10/1990
JP 6-108309 A * 4/1994
JP 11-323654 A * 11/1999
JP 2000-314045 A * 11/2000
JP 2002-4129 A * 1/2002
WO 01/25514 A1 4/2001

OTHER PUBLICATIONS

Machine Translation of JP 2002-004129.*
Machine Translation of 06-108309.*
English Abstract and Original (Japanese) of JP 04-136233.*
Takaharua et al., JP 04136233 (English Human Translation). 1992.*
Machine Translation of JP 2002-004129, Sekine et al., Jan. 2002.*
Machine Translation of JP 06-108309, Yoshioka et al., Apr. 1994.*
English Abstract and original of JP 04-136233, Ichiyanagi et al., May 1992.*

* cited by examiner

*Primary Examiner* — David R Sample
*Assistant Examiner* — Nicole T Gugliotta
(74) *Attorney, Agent, or Firm* — DLA Piper LLP (US)

(57) ABSTRACT

Fibers having excellent responsiveness to magnetic field and conductivity, made of a polymer having fiber forming functions which contains magnetic material particles in spherical form having a saturation magnetic flux density of no less than 0.5 tesla. The fibers can include: (a) the average particle diameter is no greater than 5 μm, (b) the coercive force is no greater than 1000 A/m, and (c) the fibers are complex fibers which are made of magnetic layers that contain 20 wt % to 90 wt % of magnetic material particles, and protective layers where the content of the magnetic material particles is less than 20 wt %.

20 Claims, No Drawings

FIBERS HAVING EXCELLENT RESPONSIVENESS TO MAGNETIC FIELDS AND EXCELLENT CONDUCTIVITY, AS WELL AS ARTICLES MADE OF THE SAME

TECHNICAL FIELD

This disclosure relates to fibers having excellent responsiveness to magnetic fields and excellent conductivity, as well as articles made of the same. In particular, the disclosure relates to fibers having magnetic properties and conductivity, which are excellent in resistance to heat and responsiveness to magnetic fields in a unit where a magnetic field is applied, as well as in stability of conductivity when the humidity varies. In addition, the disclosure relates to textiles using such fibers, knitted articles and cloths, such as non-woven cloths, short fibers, brush rollers made of such fiber articles, and electrophotographic apparatuses using brush rollers.

BACKGROUND ART

Conventional magnetic fibers which are affected by magnetic fields have been examined. A technology relating to magnetic fibers which are appropriate for application to magnetic recording media or application to clothing by selecting an appropriate type and added amount of magnetic particles, for example, has been disclosed (see Japanese Unexamined Patent Publication S 57 (1982)-167416 (claims)).

Concretely, fibers to which magnetic particles having a high coercive force are added have been proposed as fibers for magnetic recording media. It is necessary to use magnetic particles in needle form having a high coercive force in these fibers in order to gain magnetic fibers. However, the needle form of the used magnetic particles makes it difficult for the magnetic particles to be closely arranged in the fibers, and therefore, it is difficult to contain a high concentration of magnetic particles in the fibers. In addition, it is essential not to increase the ratio of mixture of the magnetic particles, in order to prevent the gained fibers from becoming optically opaque, because of the application. Therefore, the above proposed fibers cannot contain a high concentration of magnetic particles, and thus, lack responsiveness to magnetic fields.

Fibers to which magnetic particles having a low coercive force are added have been proposed, to give an example of magnetic fibers that are appropriate for the other application, that is, application to clothing. These fibers are used for application to clothing, and therefore, it is necessary to reduce as much as possible the amount of magnetic particles, for example, to no greater than 30 wt %, for the purpose of aesthetics. In addition, as one application, these fibers are used to gain knitted articles which are then tufted and cut so as to gain pile knit articles, and after that, processed in a magnetic field, so as to fabricate artificial fur, and according to this technology, these fibers cannot be applied as fibers for mechanical member requiring high precision in design. Thus, conductivity cannot be provided to the fibers, due to the low concentration in the ultimate amount of magnetic particles.

Furthermore, another technology relating to complex fibers with which a magnetic material is mixed has been proposed (see Japanese Unexamined Patent Publication S59 (1984)-173312 (claims, embodiments)). Such complex fibers have a structure where the cores are made of a first component with which a low concentration of magnetic material is mixed, and the sheaths are made of a second component with which a high concentration of magnetic material is mixed, where a polymer having, fiber forming properties of which the melting point is lower than that of the first component is used, and it becomes possible to magnetize the complex fibers having this configuration by means of heat treatment. However, these complex fibers are inferior in resistance to heat and rigidity, due to the low melting temperature of the polymer having fiber forming properties in the second component with which a high concentration of magnetic material has been mixed, and in addition, the fiber properties easily deteriorate with age, in such a manner that the magnetic material peels off during the use of these complex fibers, which, as a result, are inferior in durability for use over a long period of time, and cannot be used as fibers for a mechanical member.

Moreover, magnetic fibers where a magnetic substance is dispersed in fibers, and brush rollers for electro-photographic apparatuses using such fibers have been proposed (see Japanese Unexamined Patent Publication H2 (1990)-193176 (claims, embodiments) and Japanese Unexamined Patent Publication H2 (1990)-193180 (claims, embodiments)). The magnetic fibers disclosed in these patent documents are used by controlling the application of toner that is used in electrophotographic apparatuses through magnetization of the magnetic substance that is contained in the fibers. In this proposal, however, no concrete technical guidance is provided in terms of the amount of magnetic substance in the fibers for controlling the toner cleaning process or a development process through the application of toner, and therefore, the magnetizing properties of the magnetic fibers and the like are unclear. In addition, in order to provide conductivity to the fibers, it is necessary to separately use a conductive microscopic powder. Therefore, the manufacture of fibers for brush rollers which satisfy both the magnetic properties and conductivity, or the manufacture of brush rollers which are easy to clean and excellent in developing cannot be achieved in accordance with this proposed technology.

It could therefore be helpful to provide fibers having excellent responsiveness to magnetic fields and excellent conductivity, that is to say, which are excellent in responsiveness to magnetic fields in such a manner that the fibers are strongly magnetized simultaneously with the application of a magnetic field, and the fibers are not magnetized (do not become magnets) after the magnetic field is gone, and the fibers are sensitive enough to respond to magnetic fields, even when the magnetic field is weak, and in addition, are excellent in resistance to heat in the case where the fibers are incorporated in an apparatus, in the durability for use over a long period of time, and in the stability of a specific resistance value against change in the humidity.

In addition, it could also be helpful to provide textiles, knitted articles and cloths, such as non-woven cloths, using such fibers, short fibers, fiber articles, such as clothing, articles such as brush rollers using such fiber articles, and a variety of apparatuses into which such articles are incorporated.

We conducted diligent research to gain fibers having excellent responsiveness to magnetic fields and excellent conductivity, and during that research, found that it is possible to make fibers contain a material having a specific form and properties and additional merits that cannot be achieved in accordance with the prior art can be provided.

SUMMARY

That is to say, we provide fibers having excellent responsiveness to magnetic field and conductivity, made of a polymer having fiber forming functions which contains magnetic material particles in spherical form having a saturation magnetic flux density of no less than 0.5 tesla.

In addition, the fibers have the following preferred aspects:

(a) The average particle diameter of the above described magnetic material particles in spherical form is no greater than 5 μm.

(b) The coercive force of the above described magnetic material particles in spherical form is no greater than 1000 A/m.

(c) The fibers are complex fibers which are made of magnetic layers that contain 20 wt % to 90 wt % of the above described magnetic material particles in spherical form, and protective layers where the content of the above described magnetic material particles in spherical form is less than 20 wt %.

(d) The above described magnetic layers are made of a core component, the above described protective layers are made of a sheath component, and the fibers are core and sheath type complex fibers, where the above described magnetic layers make up 5 vol % to 95 vol %.

(e) The above described magnetic material particles in spherical form are made of a metal selected from a group consisting of iron, nickel and cobalt having a purity of no less than 98%.

(f) The ratio of contraction is no higher than 10% when the fibers are held in boiling water at 98° C. for 15 minutes.

(g) The residual elongation percentage is 5% to 30%.

(h) The elastic modulus of incipient tension is no less than 15 cN/dtex.

(i) The above described polymer having fiber forming functions is a polymer selected from a group consisting of a polyester based polymer having a melting point of no lower than 150° C., a polyamide based polymer, a polyolefin based polymer and a polyacrylonitrile based polymer.

(j) The specific resistance value is $10^3$ Ω·cm$^2$ to $10^9$ Ω·cm$^2$.

(k) The tensile strength is no lower than 0.5 cN/dtex.

(l) The fibers are short fibers having a specific resistance value of $10^6$ Ω·cm$^2$ to $10^9$ Ω·cm$^2$, and are made of the above described fibers.

(m) The fibers are short fibers having a fiber length of 0.05 mm to 150 mm, and are made of the above described fibers.

Textiles, knitted articles and cloths, such as non-woven cloths, can be fabricated using fibers or short fibers, as described above. In addition, the cloths have the following preferred aspects:

(a) The weaving structure is pile weaving.

(b) The knitting structure provides knitted articles selected from a group consisting of knitted articles having fleecy stitches, and knitted articles where fibers in pile form exist on the surface of the knitted articles as a result of raising treatment.

In addition, the above described fibers or short fibers can be made to adhere to and flocked in at least a portion of a base, so as to provide a flocked matter. In addition, the above described cloths can be made to adhere to at least a portion of a base, so as to provide a cloth complex. In addition, clothing can be made using the above described fibers or short fibers.

At least a portion of the above described cloths can be made to adhere to a bar, so as to provide a brush roller. The above described short fibers can also be made to adhere to and flocked in at least a portion of a bar, so as to provide a brush roller. Thus, a bar made primarily of a metal or a bar made primarily of a metal and a middle layer that covers at least a portion of the metal can be used as the bar.

A cleaning apparatus, a charging apparatus, a developing apparatus and an antistatic apparatus can be provided using a brush roller as described above, and an electro-photographic apparatus can be provided using a cleaning apparatus and/or a charging apparatus and/or a developing apparatus and/or an antistatic apparatus as described above.

DETAILED DESCRIPTION

The fibers are excellent in responsiveness to magnetic fields, that is to say, the fibers are strongly magnetized at the time of application of a magnetic field, and the fibers do not remain magnetized after the magnetic field is gone after the application of the magnetic field (that is to say, the fibers do not become magnets), and in addition, are excellent in sensitivity of response to magnetic fields, even in the case where the magnetic field is very weak. In addition, in the case where the fibers are incorporated in an apparatus, it is difficult for the fibers to be deformed at high temperatures, that is to say, the fibers are excellent in resistance to heat, and furthermore, responsiveness to magnetic fields and conductivity are not easily lost, even when the fibers are utilized for a long period of time, that is to say, the fibers are excellent in durability for use over a long period of time. Moreover, the fibers have a stable specific resistance value, even when the humidity changes, that is to say, can maintain conductivity, and thus, the fibers have excellent responsiveness to magnetic fields and excellent conductivity, and therefore, can be adopted for a variety of applications.

This is because magnetic material particles in spherical form having an average particle diameter of 5 μm or less are used, and thereby, when the magnetic material particles in spherical form are made to be contained in the fibers at a high concentration, the magnetic material particles in spherical form become of a closest packed structure, so that it becomes possible to make the magnetic material particles in spherical form be contained at a high concentration. In addition, the magnetic material particles that are contained in the fibers are in spherical form, and therefore, during the cutting process of the fibers, wear of the cutting blade and guide wear during the process can be kept at the minimum limit. Furthermore, the magnetic material particles in spherical form and the polymer that forms the fibers have a high affinity with each other in the fibers, which thus have advantages where processability at the time of processing of the fibers is excellent, in such a manner that there is little thread breaking at the time of processing.

The fibers may be short fibers, and the fibers are, as described above, fibers that are excellent in responsiveness to magnetic fields and conductivity; and therefore, the short fibers are made to be contained in a liquid, a solid, a polymer or the like, so as to work as an additive which provides responsiveness to magnetic fields and conductivity, and in addition, may also be used as fibers for the below described electric flocking. In particular, in the case where the short fibers are used for electric flocking, the content of magnetic material particles in spherical form which are added can be adjusted, so that the specific resistance value can be easily controlled and kept at a desired value. That is to say, ease of electric flocking can be controlled.

It is necessary for the fibers to contain magnetic material particles in spherical form having a saturation magnetic flux density of no less than 0.5 tesla. The saturation magnetic flux density represents responsiveness (sensitivity) to magnetic fields of a certain strength. In the case where the saturation magnetic flux density of the magnetic material particles in spherical form is no less than 0.5 tesla, the fibers easily respond to magnetic fields, and therefore, it is possible to easily control the response of the fibers with a weak magnetic field, instead of using a strong magnetic field. However, in the case where the saturation magnetic flux density is less than 0.5 tesla, responsiveness of the fibers to magnetic fields is weak, and it is necessary to apply a strong magnetic field when the fibers are used in a magnetic field. It is preferable for the saturation magnetic flux density of the magnetic material particles in spherical form to be no less than 1.0 tesla, and it is more preferable for it to be no less than 1.5 tesla. In addition, though the higher the upper limit of the saturation magnetic flux density of the magnetic material particles in spherical form, the more preferable, the fibers are preferably used when the saturation magnetic flux density is no higher than 4.0.

In addition, it is preferable for the magnetic material particles in spherical form that are contained in the fibers to have a coercive force of no higher than 1000 A/m. It is known that the coercive force has the same size as a magnetic field that is applied in the opposite direction (antimagnetic), so that the strength of magnetization is made zero in the magnetization curves of a magnetic material. In the case where the coercive force of the magnetic material particles in spherical form is no higher than 1000 A/m, the fibers do not easily become magnets. That is to say, the fibers are excellent in responsiveness to magnetic fields, in the sense that the fibers are not magnetized after a magnetic field is released after the magnetic field has been applied. In the case where the coercive force is greater than 1000 A/m, the fibers remain in the state of being magnetized after the magnetic field has been released, and therefore, in some cases, fibers stick to each other. Therefore, the fibers cannot be utilized as a member for a cleaning apparatus or a member for a developing apparatus in some applications in which the fibers are used, for example, in the case of a brush roller, as described above. It is preferable for the coercive force to be no higher than 500 A/m, it is more preferable for it to be no higher than 100 A/m, and it is most preferable for it to be no higher than 20 A/m. In addition, the lower value of the coercive force, the more preferable, and it is preferable for it to be no smaller than 0 A/m.

In addition, it is preferable for the magnetic material particles in spherical form that are contained in the fibers to be in spherical form having an average particle diameter of no greater than 5 μm. The fibers are synthetic fibers made of polymers having fiber forming functions. In the case where the magnetic material particles that are contained in the fibers are in spherical form having an average particle diameter of no greater than 5 μm, the surface area of the particles is small, due to their spherical form, and the wettability (affinity) with the polymer that forms the fibers is also excellent. In addition, the fibers are excellent in that the magnetic material particles in spherical form are contained in the fiber at a high concentration, due to the effects of closest packing, and in addition, the advantage of guide wear becoming small at the time of processing of the fibers is also gained. In the case where the fibers are used as short fibers that have been processed from the fibers, the short fibers are manufactured by cutting the fibers, which are in tow form, with a cutter. In this case, the magnetic material particles that are mixed with the fibers are in spherical form, and therefore, there is only small impact with the cutter blade, making wear of the blade very small, and thus, processability is excellent.

The average particle diameter of the magnetic material particles in spherical form is found in accordance with the method that is described in item C of the following example. In addition, whether or not the form of particles is spherical is determined in accordance with the method that is described in the same item C of the following example, where the maximum diameter (R) and the minimum diameter (r) of respective particles of the magnetic material particles in spherical form are measured, and the degree of circularity is calculated from the ratio thereof (R/r), so that the particles are determined to be in spherical form when R/r is no greater than 1.5. However, in the case where the magnetic material particles are not in spherical form, the wettability (affinity) with the polymer is poor, making it difficult to contain the magnetic material particles in the fibers at a high concentration, and thus, the responsiveness of the fibers to magnetic fields becomes poor.

Though the average particle diameter of the magnetic material particles in spherical form may be greater than 5 μm, the miscibility with the polymer may deteriorate if the average particle diameter is excessively large, and wear of the cutting blade at the time of a process for cutting the fibers, and guide wear during the process may be easily caused, and these magnetic particles might become defective portions of the fibers. Defects may be caused, in such a manner that thread breaking easily occurs, for example, during the drawing process for fabricating the fibers, or during the process using the fibers. It is preferable for the average particle diameter of the magnetic material particles in spherical form to be no greater than 4 μm, so that the magnetic material particles in spherical form can be contained in the fibers at a high concentration, and it is more preferable for it to be no greater than 3 μm. Though the smaller the lower limit of the average particle diameter, the more preferable, it is preferable for the average particle diameter to be no less than 0.001 μm, so that the particles can be stably contained in the fibers, it is more preferable for it to be no less than 0.005 μm, and it is most preferable for it to be no less than 0.01 μm.

In addition, there may be trenches or unevenness having a depth that is no greater than one tenth of the particle diameter and/or a size that is no greater than one tenth of the particle diameter, or a coating portion that does not damage the magnetic properties or the conductivity of the magnetic material particles in spherical form on the surface of the magnetic material particles in spherical form. It is preferable for the thickness of such a coating portion to be no greater than one tenth of the diameter of the magnetic material particles in spherical form.

It is preferable for the magnetic material particles in spherical form that are contained in the fibers to have conductivity, so as to make it possible for the fibers to have conductivity. The magnetic material particles in spherical form may have conductivity that is higher than that of the polymer that forms the fibers, that is to say, may have a smaller specific resistance value (in other words, volume resistivity) as an indicator of the conductivity. It is preferable for the specific resistance value of the magnetic material particles in spherical form to be no greater than 5000 Ω·cm, so that excellent conductivity can be provided to the fibers, it is more preferable for it to be no greater than 1 Ω·cm, and it is most preferable for it to be no greater than 100 Ω·cm. In addition, the smaller the lower limit of the specific resistance value, the more preferable, and it is preferable for the specific resistance value to be no smaller than 1 Ω·cm, though there are no particular limitations.

The magnetic material particles in spherical form that are contained in the fibers are, as described above, magnetic material particles in spherical form having a saturation magnetic flux density of no less than 0.5 tesla. Magnetic material particles in spherical form made of silicon steel, or permalloy, super permalloy, pennendur or the like, made of a plurality of types selected from iron, nickel, cobalt and molybdenum, in addition to a material made of a single metal, such as pure iron, pure nickel, pure cobalt and pure molybdenum, for example, can be cited as the magnetic material particles in spherical form that are used, and they can be appropriately adopted. In addition, from among these magnetic material particles in spherical form, iron, cobalt and nickel having a purity of no less than 95% are preferable, because these allow the coercive force to become small and the saturation magnetic flux density to become very large, and so-called pure iron, pure nickel and pure cobalt having a purity of no less than 98% are more preferable. In particular, pure iron and pure nickel that are manufactured in accordance with a carbonyl method are most preferable for use, because they normally have a purity of no less than 99% and are in spherical form. The higher the purity of this pure iron, pure nickel or pure cobalt, the more preferable, and these metals having a purity of up to 100% are appropriate for use. One type of these magnetic material particles in spherical form may be used alone, or a number of types may be used together in accordance with the purpose of use.

An arbitrary method for adding magnetic material particles in spherical form to a polymer component having fiber forming functions can be adopted as the method for containing magnetic material particles in spherical form in a polymer for the fabrication of the fibers. As a concrete example of such a method, (A) a method for melting a polymer in an inert gas atmosphere, adding magnetic material particles in spherical form to the melt, and kneading the resulting substance under normal pressure or reduced pressure by means of a kneader, such as an extruder or a static mixer, (B) a method for kneading a conventional polymer, which is made to contain magnetic material particles in spherical form, during a polymerization reaction at an arbitrary stage before the polymerization reaction stops and the like can be cited. The above described method (A) is preferably adopted, because kneading can be easily performed, and the magnetic material particles in spherical form and the polymer component are kneaded thoroughly. In particular, as for the extruder, an extruder having single screw or a multiple screw extruder having two or more screws is appropriate for use. It is preferable to adopt a multiple screw extruder having two or more screws, so that magnetic material particles in spherical form are kneaded thoroughly when a polymer and the magnetic material particles in spherical form are kneaded. Though the ratio 1/w of the length (1) of the screw of an extruder to the thickness (w) of the screw is not particularly limited, it is preferable for 1/w to be no less than 10, so that kneading is performed well, it is more preferable for it to be no less than 20, and it is most preferable for it to be no less than 30.

In addition, when magnetic material particles in spherical form are added, the mixture may be blended in a drying manner at a stage before the material is supplied to an extruder, or magnetic material particles in spherical form may be mixed with a melt polymer in an extruder using a side feeder that is provided to the extruder. In addition, in the case of a static mixer, there is no particular limitation as to the type used, as long as it is a stationary kneading element where, for example, the task of splitting the flow path of a melt polymer into two or more numbers and unifying them again (this one task, from the split to the unification, is referred to as one stage) can be performed. It is preferable for the number of stages of a static mixer to be no smaller than 5, so that kneading is excellent, and it is more preferable for it to be no smaller than 10. In addition, it is preferable for the number of stages of the flow path to be no greater than 50, though it depends on the required length.

The fibers are basically made of a polymer having fiber forming functions that is made to contain magnetic material particles in spherical form. The term fibers indicates those in long, thin form, and may be long fibers (filaments), as generally called, short fibers (staples) having a width of 0.05 mm to 150 mm, or short fibers usually having a length that is no longer than 10 mm which are used for electric flocking processes, and fibers made of a polymer having fiber forming functions that can be made into these fiber forms can be applied as the fibers. An appropriate length for the fibers can be selected in accordance with the purpose or method of, or the application for use. It is preferable for the fiber length of short fibers that are used for electric flocking processes to be 0.1 mm to 10 mm, and it is more preferable it to be 0.2 mm to 5 mm.

It is preferable for short fibers to have a specific resistance value of $10^6$ Ω·cm to $10^9$ Ω·cm, so that they can be efficiently utilized during electric flocking processes. The fibers contain magnetic material particles in spherical form at a high concentration, and short fibers that have been cut so that the fiber length becomes 0.1 mm to 10 mm have the same specific resistance value as that of the fibers before being cut, and therefore, in some cases, the specific resistance value is less than $10^6$ Ω·cm. However, the specific resistance value of fibers that are used for electric flocking is usually $10^6$ Ω·cm to $10^9$ Ω·cm, and it is more preferable for it to be $10^7$ Ω·cm to $10^8$ Ω·cm. Thus, it is preferable for the short fibers to be processed with a conductivity adjuster, so that the short fibers have a specific resistance value that is seemingly preferable. As for the conductivity adjuster, water soluble chemicals or organic chemicals with which silica based particles are mixed, for example, can be cited. The particle diameter of the silica based particles at this time is usually 1 nm to 200 μm, and it is more preferable for the particle diameter of the particles that are used to be 3 nm to 100 μm.

As for the polymer having fiber forming functions which is used for the fibers, polyester based polymers, polyamide based polymers, polyimide based polymers, vinyl based polymers such as polyacrylonitrile based polymers that are synthesized through addition polymerization of polyolefin based polymers or other vinyl groups, fluorine based polymers, cellulose based polymers, silicone based polymers, aromatic or aliphatic ketone based polymers, elastomers such as natural rubbers and synthetic rubbers and other various types of engineering plastics, for example, can be cited.

As for the polymer having fiber forming functions, polyolefin based polymers that are synthesized of monomers having vinyl groups through a mechanism where a polymer is generated through addition polymerization reaction such as radical polymerization, anionic polymerization or cationic polymerization, for example, can be more concretely cited. As for other vinyl based polymers, polyethylene, polypropylene, polybutylene, poly(methyl pentene), polystyrene, poly (acrylic acid), poly(methacrylic acid), poly(methyl methacrylate), polyacrylonitrile, polytetrafluoroethylene, pOly (vinyliden fluoride), poly(vinyliden chloride) and poly (vinyliden cyanide) and the like can be cited. These may be polymers resulting from homopolymerization such as, for example, only polyethylene or only polypropylene or may be copolymers which are formed by carrying out polymerization reaction under the existence of a number of types of monomers. When polymerization is carried out under the coexistence of styrene and methyl methacrylate, for example, a copolymer, which is referred to as poly(styrene-methacrylate) is generated and a polymer that is gained as such a copolymer may be used.

In addition, as for the polymer having fiber forming functions, polyamide based polymers that are formed through reaction of carboxylic acid or carboxylate chloride and amine, for example, can be cited. Concretely, nylon 6, nylon 7, nylon 9, nylon 11, nylon 12, nylon 6, 6, nylon 4, 6, nylon 6, 9, nylon 6, 12, nylon 5, 7 and nylon 5, 6 can be cited. In addition, polyamide based polymers made of other aromatic, aliphatic, and/or alicyclic dicarboxylic acid and aromatic, aliphatic, and/or alicyclic diamine component may be used. In addition, at least one compound from among aromatic, aliphatic, and alicyclic compounds may be a polymer where an amino carboxylate compound which has both a carboxylic acid and an amide acid is solely used, or may be a polyamide based polymer where the third or fourth copolymer component is copolymerized.

In addition, as for the polymer having fiber forming functions, polyester based polymers which are formed through esterification reaction of carboxylic acid and alcohols, for example, can be cited. As for the polyester based polymers, polymers that are formed by ester bond between dicarboxylate compounds and diol compounds, for example, can be cited. As for these polyester based polymers, poly(ethylene terephthalate), poly(propylene terephthalate) (which is also referred to as poly(trimethylene terephthalate)), poly(butylene terephthalate) (which is also referred to has poly(tetramethylene terephthalate)), poly(ethylene naphthalate) and poly (cyclohexane dimethanol terephthalate) and liquid crystal polyester having liquid-crystallinity in the melt of which the main component is aromatic hydroxy carboxylate can be cited.

In addition, the polyester based polymers that are formed by ester bond between dicarboxylate compounds and diol compounds may be copolymerized with other components such as dicarboxylate compounds. As for such dicarboxylate compounds, aromatic, aliphatic and alicyclic dicarboxylic acid such as terephthalic acid, isophthalic acid, naphthalene dicarboxylate, diphenyl dicarboxylate, anthracene dicarboxylate, phenanthrene dicarboxylate, diphenyl ether dicarboxylate, diphenoxy ethane dicarboxylate, diphenyl ethane dicarboxylate, adipic acid, sebacic acid, 1,4-cyclohexane dicarboxylate, 5-sodium isophthalic sulfate, 5-tetrabutyl isophthalic phosphate, azelaic acid, dodecanedionic acid and hexahydroterephthalate, as well as derivatives, adducts, constitutional isomers and optical isomers of these including, alkyl, alkoxy, allyl, aryl, amino, imino and halides, for example, can be cited. One type from among these dicarboxylate compounds may be used or two or more types may be combined for use.

In addition, as for the copolymer components of the polyester based polymers, diol compounds may be copolymerized. As for such diol compounds, aromatic, aliphatic, and alicyclic diol compounds such as ethylene glycol, propylene glycol, butylene glycol, pentane diol, hexane diol, 1,4-cyclohexane dimethanol, neopentyl glycol, hydroquinone, resorcin, dihydroxybiphenyl, naphthalene diol, anthracene diol, phenanthrene diol, 2,2-bis(4-hydroxyphenyl) propane, 4,4'-dihydroxy diphenyl ether and bisphenol S, as well as derivatives, adducts, constitutional isomers and optical isomers of these including, alkyl, alkoxy, allyl, aryl, amino, imino and halides, for example, can be cited. One type from among these diol compounds may be used or two or more types may be combined for use.

In addition, as for the copolymer components of the polyester based polymers, compounds having a hydroxyl group and a carboxylic acid in one compound, that is to say hydroxy carboxylates can be cited. As for such hydroxy carboxylates, aromatic, aliphatic and alicyclic diol compounds such as lactic acid, 3-hydroxy propionate, 3-hydroxy butyrate, 3-hydroxy butyrate varilate, hydroxybenzoate, hydroxynaphthoate, hydroxy anthracene carboxylate, hydroxy phenanthrene carboxylate and (hydroxy phenyl) vinyl carboxylate, as well as derivatives, adducts, constitutional isomers and optical isomers of these, including alkyl, alkoxy, allyl, aryl, amino, imino and halides, for example, can be cited. One type from among these hydroxy carboxylates may be used or two or more types may be combined for use.

In addition, as for the polyester based polymers, one compound from among aromatic, aliphatic and alicyclic compounds may be a polymer of which the main units that are repeated are made of a hydroxy carboxylate compound having both a carboxylic acid and a hydroxyl group. As for the polymers that are made of these hydroxy carboxylates, poly (hydroxy carboxylate) such as polylactic acid, poly (3-hydroxy propionate), poly(3-hydroxy butyrate) and poly(3-hydroxy butyrate varilate), for example, can be cited. In addition to these, aromatic, aliphatic and alicyclic dicarboxylates or aromatic, aliphatic and alicyclic diol components maybe used in the above described poly(hydroxy carboxylate) or copolymers of a number of types of hydroxy carboxylates may be used.

In addition to the above, as for the polymer having fiber forming functions which are used for the fibers, polycarbonate based polymers which are formed through an ester exchange reaction between an alcohol and a carbonate derivative, polyimide based polymers which are formed through cyclization polycondensation between carboxylic acid anhydride and diamine, and polybenzoimidazole based polymers which are formed through a reaction between dicarboxylate ester and diamine can be cited. In addition, polysulfone based polymers, polyether based polymers, polyphenylene sulfide based polymers, polyether ether ketone based polymers, polyether ketone ketone based polymers, polymers including aliphatic polyketones, and furthermore, cellulose based polymers, chitin, chitosan and derivatives of these, as well as polymers gained from natural polymer compounds can be cited.

The fibers are sometimes used at high temperatures, particularly when incorporated into a machine as an application, and therefore, it is preferable'for the fibers to change as little as possible in form at high temperatures, that is to say, to be excellent in resistance to heat. Therefore, polymers of which the melting point is no lower than 150° C. and which are made of polyester based polymers and/or polyamide based polymers and/or polyolefin based polymers and/or polyacrylonitrile based polymers are preferably used. In particular, polyester based polymers and/or polyamide based polymers of which the melting point is no lower than 200° C. are preferably used. The melting point indicates a peak temperature that is measured in accordance with the method described in item B in the below described example.

As for the polyester based polymers and/or polyamide based polymers and/or polyolefin based polymers of which the melting point is no less than 150° C., polyester and/or copolymer polyesters of these, such as poly(ethylene terephthalate), poly(propylene terephthalate) (which is also referred to as poly(trimethylene terephthalate)), poly(butylene terephthalate) (which is also referred to as poly(tetramethylene terephthalate)), poly(ethylene naphthalate), poly(cyclohexane dimethanol terephthalate), poly(lactic acid), as well as polyamide and/or copolymer polyamide of these, such as nylon 6, nylon 11, nylon 12, nylon 6,6, nylon 4,6, nylon 6, 9, nylon 6, 12, nylon 5, 7, and nylon 5, 6, and polypropylene and poly(methyl pentene), for example, can be cited. From among these, poly(ethylene terephthalate) and/or copolymer of which the main repeating units are ethylene terephthalate, nylon 6 and/or copolymers of these are more preferably used. In particular, copolymer polymers of which the main repeating units are polyethylene terephthalate and/or ethylene terephthalate have a low rate of moisture absorption, and little change in the form specific resistance value against a change in the environment, such as a change in the humidity, when used so as to be incorporated in the below described electrophotographic apparatus, and therefore, make it possible to stably maintain a desired specific resistance value.

For the manufacture of the fibers, one type of polymer selected from the above may be used, or a number of types of polymers may be used together.

As for the polymers that are used for the fibers, polymers having a viscosity that is provided to artificial fibers can be normally utilized. In the case of poly(ethylene terephthalate), which is one type of polyester based polymer, for example, it is preferable for the intrinsic viscosity (IV) to be 0.4 to 1.5, and it is more preferable for it to be 0.5 to 1.3. In addition, in the case of poly(propylene terephthalate), it is preferable for the IV to be 0.7 to 2.0, and it is more preferable for it to be 0.8 to 1.8. In the case of poly(butylene terephthalate), it is preferable for the IV to be 0.6 to 1.5, and it is more preferable for it to be 0.7 to 1.4. In addition, in the case of nylon 6, which is one type of polyamide based polymer, it is preferable for the limiting viscosity [η] to be 1.9 to 3.0, and it is more preferable for it to be 2.1 to 2.8.

In addition, the melt viscosity of the polymers that are used for the fibers is not particularly limited, and polymers of which the shear viscosity is 10 poise to 100,000poise when the shear rate is 10 $sec^{-1}$ are usually used, and preferably, polymers having 100 poise to 50,000 poise are used under the melt spinning temperature of the polymers used.

The fibers may be fibers made of a single component that uniformly contain magnetic material particles in spherical form. In addition, the fibers may be fibers having properties which have two types of effects, such that responsiveness to magnetic fields and conductivity are excellent, and the smoothness of the fibers which undergo processing and ease of handling are excellent, so that the fibers have these two types of effects together. Therefore, it is preferable for the fibers to be complex fibers which are made of magnetic layers that contain 20 wt % to 90 wt % of magnetic material particles in spherical form, and protective layers of which the content of magnetic material particles in spherical form is less than 20 wt %.

The magnetic layers in the complex fibers contain magnetic material particles in spherical form at a high concentration, and therefore, are made of a component that mainly allows the fibers to exhibit responsiveness to magnetic fields and conductivity. Meanwhile, the protective layers either do not contain or contain a small amount of magnetic material particles in spherical form, and therefore, are made of a component that allows the fibers to have smoothness when the fibers undergo processing, or fiber properties which are not disadvantageous when the fibers are treated as fibers. It is preferable for the magnetic layers of the fibers to contain 30 wt % to 85 wt % of magnetic material particles in spherical form, so that the gained fibers have excellent responsiveness to magnetic fields and high conductivity, and it is more preferable to contain 40 wt % to 80 wt % of magnetic material particles in spherical form. In addition, it is preferable for the protective layers to have a content of magnetic material particles in spherical form of no greater than 10 wt %, so that the fibers have smoothness when the fibers are processed as described above, and are excellent in fiber properties, such as tensile strength and elongation, and it is more preferable for them not to contain magnetic material particles in spherical form.

In addition, as for examples of complex forms of the complex fibers which are preferable as the fibers, (a) bimetal type complex fibers where magnetic layers are pasted to protective layers, (b) half core and sheath type complex fibers where magnetic layers form cores that are partially exposed from the surface of the fibers, and protective layers covers magnetic layers, excluding the exposed portions of the magnetic layers, or protective layers are partially exposed from the surface of the fibers and form cores, and magnetic layers cover the protective layers, excluding the exposed portions of the protective layer, (c) core and sheath type complex fibers where magnetic layers are cores and protective layers are sheaths which completely cover the magnetic layers, or protective layers are cores and magnetic layers are sheaths which completely cover the protective layers, (d) sea and island type complex fibers where magnetic layers form islands and protective layers make up the sea, which completely covers a number of islands, and (e) blended complex fibers where a component that forms magnetic layers and a component that forms protective layers are kneaded can be cited.

The core and sheath type complex fibers where magnetic layers are cores and protective layers are sheaths which completely cover the magnetic layers, or sea and island type complex fibers where magnetic layers form islands and protective layers make up the sea which completely covers a number of islands are preferable, so that the smoothness when the gained fibers undergo processing and the processability of the gained fibers become excellent. The core and sheath type complex fibers where magnetic layers are cores and protective layers are sheaths which completely cover the magnetic layers are more preferable, because the manufacture becomes easy.

In addition, the structure of the core and sheath type complex fibers is not particularly limited, as long as it is a structure where the sheaths completely include the cores, and may be of a concentric core and sheath type or an eccentric core and sheath type, and the concentric core and sheath type is more preferable. Furthermore, as for the ratio of the complex in the core and sheath type complex fibers, it is preferable for the magnetic layer to be 5 vol % to 95 vol %, so that responsiveness to magnetic fields and conductivity become excellent, it is more preferable for it to be 30 vol % to 90 vol %, and it is more preferable for it to be 50 vol % to 85 vol %.

In the case where the specific gravity of the magnetic material particles in spherical form that are contained in the fibers is great, the specific gravity of the gained fibers also tends to become great. Therefore, in the case where the fibers are adopted, for example, as the fibers for electric flocking, it sometimes becomes necessary to adjust the specific gravity of the fibers to an appropriate value in accordance with the method for use or the application. Thus, hollow portions that penetrate through the inside of the fibers in the axial direction of the fibers may be provided, or hollows that do not penetrate may be provided, so that the fibers can gain an appropriate specific gravity. As for the method for providing hollows that do or do not penetrate, (a) a method for providing hollows in the fibers by using a mouthpiece having a discharging hole in a special form which can form pseudo-circular hollows with slits at the time of spinning of the fibers, (b) a method for generating hollows that do or do not penetrate by making a component that is easily solved in water, hot water or an organic solvent elute when spinning the fibers together with this component, and (c) a method for peeling the polymer that forms the fibers from the magnetic material particles in spherical form and generating hollows by drawing the fibers at a high drawing ratio, for example, can be cited. In particular, the easily solved component can be eluted and removed using water, hot water, another solution where organic and/or inorganic compounds are solved, an organic solvent or a liquid that is gained by mixing a number of types of liquids selected from among these. It is preferable to elute the component with water, hot water or a solution where organic and/or inorganic compounds are solved.

As for the above described eluted component, polyester which is easily solved in alkaline, hot water soluble polyester, poly(ethylene glycol) and poly(ethylene oxide), water soluble thermoplastic poly(vinyl alcohol), ethylene-vinyl alcohol copolymer and polysaccharide compounds, for example, can be cited. Polyester which is easily solved in alkaline, and hot water soluble polyester, which is easily solved in hot water, are preferable for use, because handling is easy in the melt spinning.

It is preferable for the fibers to be excellent in resistance to heat, because in some cases, they may be exposed to high temperatures of no lower than 50° C., depending on the environment at the time of use. Therefore, it is preferable for the ratio of contraction of the fibers to be no greater than 10% when the fibers are held in boiling water at 98° C. for 15 minutes, and it is more preferable for it to be no greater than 5%. The lower the ratio of contraction, the better, and fibers having a ratio of contraction of up to 0% can be used. As for the ratio of contraction, that which is measured in accordance with the method of item E of the below described example is adopted.

It is preferable for the residual elongation percentage of the fibers to be no less than 5% to 30%, because the change in form at the time of use becomes small, and it is more preferable for it to be 5% to 15%. The residual elongation percentage that is measured in accordance with the method of item D in the below example is adopted.

It is preferable for the elastic modulus of incipient tension of the fibers to be no less than 15 cN/dtex, so that the fibers can resist stress that is momentarily large when used in a magnetic field, and it is more preferable for it to be no less than 20 cN/dtex. Though the higher the elastic modulus of incipient tension, the better, fibers of which the elastic modulus of incipient tension is no greater than 1000 cN/dtex are preferably used. Here, the elastic modulus of incipient tension that is measured in accordance with the method of item D of the below described is adopted.

It is preferable for the tensile strength of the fibers to be no less than 0.3 cN/dtex, so that the fibers have a form and properties that are satisfactory for a variety of applications, it is more preferable for it to be no less than 0.5 cN/dtex, and it is most preferable for it to be no less than 1.0 cN/dtex. Though the higher the tensile strength, the better, fibers of which the tensile strength is no greater than 25 cN/dtex are preferably used. Here, the tensile strength that is measured in accordance with the method of item D of the following example is adopted.

In the fibers, the specific resistance value of the fibers can be controlled by adjusting the content of the contained magnetic material particles in spherical form. Therefore, the specific resistance value can be appropriately set on the basis of the application or the purpose. In addition, it is preferable for the specific resistance value of the fibers to be $10^2$ Ω·cm to $10^9$ Ω·cm, so that the fibers can secure stable fiber properties on the basis of the above described residual elongation percentage and tensile strength, as well as stable conductance properties at the time of application, such as that described below, for example, when incorporated in an electro-photographic apparatus, and it is more preferable for it to be $10^3$ Ω·cm to $10^9$ Ω·cm. The specific resistance value that is measured in accordance with the method of item G of the below described example is adopted.

Next, a preferred manufacturing method for the fibers is illustrated and described.

The fibers can be manufactured using a variety of spinning methods for synthetic fibers, such as melt spinning and solution spinning, including, dry spinning, wet spinning and dry-wet spinning. Solution spinning, for example, can be cited in the case where a polyacrylonitrile based polymer as that described above is used, and in addition, the fibers can preferably be manufactured through melt spinning, because it is easy and possible to make the fibers contain magnetic material particles in spherical form at a high concentration, and the form of the fibers can be precisely controlled. The fibers can be gained by carrying out melt spinning solely on the polymer component that contains magnetic material particles in spherical form. In addition, the fibers can be gained as complex fibers, as described above. Concretely, a component of magnetic layers that contains magnetic material particles in spherical form at a high concentration and a component of protective layers that either does not contain or contains a small amount of magnetic material particles in spherical form are separately melted, core and melt spinning is carried out at a stage before the melts are discharged from a mouthpiece so that the magnetic layers form the cores and the protective layers form the sheaths for sheath complex type fibers, or, so that magnetic layers form islands and protective layers make up the sea in sea and island complex type fibers, and then, the fibers are discharged from the mouthpiece.

The discharged fibers are cooled to a temperature that is no higher than the glass transition temperature (Tg), and a treating agent is attached to the fibers if necessary, and after that, the fibers are taken up at a taking up velocity of 100 m/min to 10,000 m/min, preferably no greater than 4,000 m/min, more preferably no greater than 3,000 m/min, and still more preferably no greater than 2,500 m/min, and most preferably, no greater than 2,000 in/min. In addition, the fibers should be taken up at a taking up velocity of no less than 50 m/min, taking productivity into consideration. An appropriate number of fibers per bundle (number of fibers in thread form) that are discharged from the mouthpiece may be selected in accordance with the target method for use or the application for use. The fibers may be in the state of a single mono-filament, or a multiple filament made of a number, no greater than 3,000, of threads. It is preferable for the number of fibers per bundle to be 4 to 500, because fibers having stable properties can be gained, and it is more preferable for it to be 6 to 150. In addition, an appropriate treating agent can be attached to the fibers on the basis of the application. As for the treating agent, a water containing or non water containing treating agent can be adopted, and the non water containing agent is preferable, so. that the magnetic material particles in spherical form can be prevented from deteriorating.

Without being wound or after having been wound once after a bundle of fibers has been taken up, the fibers are heated to a temperature that is no higher than the glass transition temperature (Tg) of the polymer that forms the fiber+100° C., preferably to a temperature in a range from the glass transition temperature Tg−20° C. to Tg+80° C., and then, are drawn at an drawing ratio that makes the residual elongation percentage of the drawn threads 5% to 30%, preferably at an drawing ratio that makes the residual elongation percentage of the expanded threads 5% to 15%. It is preferable for the fibers that are thus spun to be heated to a temperature that is no higher than the glass transition temperature (Tg) of the polymer that forms the magnetic layers+100° C., preferably to a temperature in a range from the glass transition temperature of the polymer that forms the magnetic layers Tga−20° C. to Tg+80° C. for carrying out an drawing process. In addition, after having been drawn once (that is to say, after the completion of first drawing stage), second drawing stage may further be carried out, at an drawing ratio of no less than one time to no greater than two times.

After the drawing, it is preferable to carry out heat treatment on the fibers at a temperature that is no lower than Tg+10° C. and no higher than the melt point (Tm), and it is more preferable to carry out heat treatment at a temperature that is no lower than Tg+50° C. and Tm−10° C. Fibers having excellent resistance to heat can be gained by carrying out heat treatment at a high temperature after drawing. It is preferable to carry out heat treatment on the fibers that have been gained herein at a temperature that is no lower than the glass transition temperature of the polymer that forms the magnetic layers Tga+10° C., and no higher than the melting point of the polymer that forms the protective layers (Tmb), and it is more preferable to carry out heat treatment at a temperature that is no lower than the melting point of the polymer that forms the magnetic layers (Tma) and no higher than Tmb.

In the above described drawing method and heat treatment method after drawing, a contact type heater in heated pin form, roller form or plate form can be used. In addition, a contact type bath using a heated liquid, or a non contact type heating medium, such as a heated gas, a heated vapor or electromagnetic waves can also be adopted. A contact type heater and a contact type bath are preferable, because the apparatus is simple and the heating efficiency high, and a contact heater in heated roller form is more preferable.

The fibers can be applied to cloths, such as textiles, knitted articles and non-woven cloths. Furthermore, the fibers may be fibers on which draw texturing processing has been carried out in the case where they are used for application to a variety of clothing. In the draw texturing processing, the fibers are heated by means of a heater in pin form, roller form or plate form, or a non-contact type heater, where drawn threads or non-drawn threads are heated or not heated, and after that, draw texturing processing is carried out by means of a tool in disc form or belt form. It is preferable for the fibers on which draw texturing processing has been carried out to be wound as they are or after having been thermally set an additional time.

Though the diameter of a single fiber of the fibers is not particularly limited, it is preferable for the diameter of the single fiber to be no greater than 1,000 μm, so that the fibers can contain magnetic material particles in spherical form at a high concentration and it becomes possible to adopt the fibers for a variety of applications, and it is more preferable for it to be 0.1 μm to 100 μm, and it is most preferable for it to be 0.5 μm to 50 μm. In addition, in the case where the fibers are incorporated in a charging apparatus for a brush roller as described below, it is preferable for the diameter of the single fiber to be 0.5 μm to 10 μm, so that the fibers have excellent charging performance.

In addition, though the form of the cross section of a fiber is not particularly limited, it is preferable for it to be round, so as to have uniform fiber properties. In addition, in the case where the fibers in short fiber, textile, knitted article or non woven cloth form are incorporated in a brush roller, so that the fibers have anisotropic properties in the direction in which the fibers bend, in accordance with the application or the purpose for use, or so that the fibers make good contact with toner in an electro-photographic apparatus, it is preferable for the form of the cross section to be flat, polygonal, multi-lobed, hollow or undetermined form.

The fibers may hold a small amount of additives, such as matting agents, flame retardants, lubricants, anti-oxidation agents, ultraviolet absorbing agents, infrared absorbing agents, crystal seeds, fluorescence enhancing agents and terminal group end-capping agents. In addition, these additives may be held in magnetic layers and/or protective layers in the case where the fibers of are complex fibers. Furthermore, the fibers may contain other magnetic materials or conductive materials. Here, conductive carbon black and metals of which the specific resistance value is no greater than 10,000 Ω·cm and no smaller than 1 nΩ·cm can be cited as examples of other conductive materials.

The fibers can be used as at least a portion or the entirety of textiles, depending on the application and the form of the object in which they are used. A for the textiles, broad, voile, lawn, gingham, tropical, taffeta and shantung and dessin, which are plain weaves, denim, surge and gabardine, which are twill weaves, satin and doeskin, which are satin weaves, basket, panama, mat, hopsack and oxford, which are mat weaves, grosgrain, ottoman and haircord, which are rib weaves, French twill, herringbone and broken twill, which are steep twill, reclined twill, pointed twill, broken twill, skipping twill, curved twill, ornament twill, irregular satin, overlapping satin, drawn satin, checkerboard satin, honeycomb weave, huckaback weave, crape weave and Niagara, for example, can be cited as single textile. In addition, as for double textiles, where two sheets of textiles are combined as one sheet of textile, double warp textiles, such as pique and matelasse, double weft textiles, such as Bedford cord, double warp and weft textiles, such as reversible figured weave and hollow weave, for example, can be cited. In addition, as for pile textiles, weft pile weaves such as velveteen and corduroy, and weft pile weaves such as towel, fine matte and velvet can be cited. In addition to the above, gauze and leno weaves, such as gauze weaves and leno weaves, as well as figured cloths, such as dobby cloth and Jacquard cloth, can also be cited, and in particular, pile weaves are preferable for textiles for brush rollers. The fibers, which are used to fabricate textiles, may be raw threads, twine, processed threads or the like, and the form of the fibers may be long fibers (filaments) or short fibers (staples).

In addition, the fibers can be used as at least a portion or the entirety of knitted articles, depending on the application or the form of the object in which they are used. As for the knitted articles, plain knitted fabrics, such as plain stitch fabric and single fabric, rib knitted fabrics, such as plain rib knitted fabrics and circular rib knitted fabrics, pearl knitted fabrics, such as links, as well as weft knitted articles, such as doeskin, crape knitted fabrics, accordion knitted fabrics, small pattern, lace knitted fabrics, fleecy stitch, half cardigan stitch, cardigan stitch, ripple stitch, Milan rib and double pique, can be cited. In addition, warp knitted articles, such as tricot, raschel and Milanese, can also be cited as the knitted articles. In particular, as for the knitted articles which are used as the knitted articles for brush rollers, knitted articles on which raising treatment has been carried out in order to make fleecy stitch or fibers in pile form protrude from the surface of the knitted articles are preferable. The fibers which are used for the fabrication of knitted articles may be raw threads, twine or processed threads, and the form of the fibers may be long fibers (filaments) or short fibers (staples).

The fibers can be used for at least a portion or the entirety of non-woven cloths, depending on the application or the purpose for use. As for non-woven cloths, those which are formed in accordance with a bonding or adhesion method, such as a chemical bonding method, a thermal bonding method, a needle punching method, a water jet punching (spun lace) method, a stitch bonding method or a felt method, can be cited. The fibers that are used for the fabrication of non-woven cloths maybe raw threads, twine or processed threads, and the form of the fibers may be long fibers (filaments) or short fibers (staples).

Processing, such as refining, dying and thermal setting, may be carried out on the textiles or knitted articles in accordance with a conventional method. In addition, physical processing, such as planish pressing, emboss pressing, compact processing, softening processing or heat setting maybe carried out on the non-woven cloth. Chemical processing, such as bonding processing, lamination processing, coating processing, stain proof processing, water repellant processing, anti-electrostatic processing, flame proof processing, insect proof processing, hygienic processing or foam resin processing, or application processing, such as microwave application, ultrasonic application, far infrared ray application, ultraviolet ray application or low temperature plasma application may be carried out on the non-woven cloth.

In addition, the fibers and other synthetic fibers, semi-synthetic fibers and natural fibers which are different from the fibers may be mixed for use in the textiles, knitted articles and non-woven cloth. The fibers may be used together with at least one type of fiber selected from, for example, cellulose based fibers, wool, silk, stretch fibers and acetate fibers. As for the cellulose based fibers, natural fibers, such as cotton and hemp, copper ammonium rayon, which does not contain the magnetic material particles in spherical form, rayon and polynosic, can be cited. It is preferable for the content of the fibers that are mixed for use with these cellulose fibers to be in a range from 0.1% to 50%, so that the feel, moisture absorbing properties, water absorbing properties and anti-static properties of the cellulose fibers can be exhibited, and the conductivity which is required for the fibers, as well as responsiveness to magnetic fields, depending on the application, can be exhibited. In addition, as for wool or silk that may be used in the mixture, existing ones can be used as they are. It is preferable for the content of the fibers that are mixed for use with these wool or silk fibers to be in a range from 0.1% to 50%, so that the feel, warmth and volume of wool, as well as the feel and rustling sound of silk, can be exhibited, and the conductivity which is required for the fibers, as well as responsiveness to magnetic fields, depending on the application, can be exhibited. In addition, as for the stretch fibers that are mixed for use, polyurethane fibers that have been dry spun or melt spun, poly(butylene terephthalate) fibers, poly(tetramethylene glycol) copolymer and polyester based elastic-threads, including poly(butylene terephthalate) fibers, can be cited. It is preferable for the content of the fibers in the cloth where stretch fibers are mixed for use to be approximately 0.1% to 50%. In addition, the acetate fibers that are mixed for use may be diacetate fibers or triacetate fibers. It is preferable for the content of the fibers which are mixed for use with any of these acetate fibers to be in a range from 0.1% to 50%, so that the feel, clarity and gloss of the acetate fibers are exhibited, and the conductivity of the fibers, and responsiveness to magnetic fields, depending on the application, are exhibited.

As for the method for mixing the fibers for use in these varieties of textiles, knitted articles and non-woven cloths, union fabrics where the fibers are used as warps or wefts, textiles such as reversible fabrics, and textiles such as tricot and raschel can be cited. The fibers may be entwined, combined or entangled into threads with other fibers.

Cloths such as textiles, knitted articles and non-woven cloths, where the fibers are used as at least a portion or the entirety of the cloth, including mixed cloths as those described above, may be dyed. After knitting or weaving, or, in the case of a non-woven cloth, after forming webs which are bonded or attached in accordance with a method as described above, the cloth can undergo processing, such as refining, presetting, dying and final setting, in accordance with a conventional method. In addition, in the case where the fibers are formed of a polyester based polymer, mass reducing alkaline processing may be carried out if necessary, after refinement and before dying, in accordance with a conventional method. It is preferable for the refinement to be carried out in a temperature range of 40° C. to 98° C. In particular, in the case of a cloth where the fibers are mixed for use with stretch fibers, it is preferable to refine the cloth in a relaxed state, so as to increase the elasticity. Though it is possible to omit one or both thermosetting steps before and after dying, it is preferable to carry out both, in order to enhance the stability in the form of the cloth and the properties that make it easy to dye. It is preferable for the temperature for thermosetting to be in a range from 120° C. to 190° C., and it is more preferable for the range to be from 140° C. to 180° C. In addition, it is preferable for the duration of thermosetting to be in a range from 10 seconds to 5 minutes, and it is more preferable for the range to be from 20 seconds to 3 minutes.

The fibers have excellent responsiveness to magnetic fields and excellent conductivity, and therefore, are very useful as fibers, and thus, the fibers can be utilized as they are. In addition, the fibers can be appropriately used as short fibers having a length of 0.05 mm to 150 mm, which is one form of the fibers, as described above. The short fibers are formed by cutting individual filaments in thread form, or a number of threads which are bundled into a tow form. In particular, short fibers having a length of 0.1 mm to 10 mm can be made to adhere to a base and flocked in accordance with any of a variety of methods, such as electrical flocking processing or spraying processing, so as to be formed into a flocked matter. 50% or more of short fibers that have been flocked in accordance with electrical flocking processing is made to adhere in a state where they stand on the base at an angle of approximately 10° to 90° (that is, perpendicularly). The short fibers that are used for making flocked matter as described above may be made of the fibers, or a mixture of the fibers and short fibers that are made of other fibers which are different from the fibers. In addition, it is preferable to use, for example, an acryl based, urethane based or ester based adhesive when short fibers are made to adhere to a base and flocked in a flocked matter. It is preferable for the thickness of the layer of the adhesive to be 1 μm to 50 μm, and a single layer of adhesive may be used, or, if necessary, a number of types of adhesive may be mixed, or a number of layers of adhesive may be used.

In addition, as for the base where short fibers are flocked, an appropriate one can be adopted on the basis of the apparatus in which the flocked matter is incorporated, the used adhesives and the intensity of the magnetic field. As the base, films, sheets, plates and cloths made of synthetic resins, natural resins, synthetic fibers, natural fibers, woods, minerals, metals or paper can be cited. Alternatively, processed bodies of a metal, processed bodies of a synthetic or natural resin, or formed bodies, which are members for each application, may be used as the base. In particular, in order to enhance the affinity with an adhesive as described above, a sheet made of a synthetic or natural resin, or a metal on which processing for providing hydrophilic properties is preferably used. In the case where the base has front and rear sides, for example, in the case of films, sheets, paper, plates or cloths as those described above, both sides, the front surface and the rear surface, may be flocked, depending on the application and the purpose.

The flocked matter has conductivity, and therefore, is appropriate for use as an electrostatic brush, for example.

Textiles, knitted articles and non-woven cloths where the fibers are used as at least a portion thereof can be made to adhere to a base so as to form a cloth complex. In the case of textiles, it is preferable for the textiles to have raised threads or terminals of the thread on the surface of the textiles as a result of pile weaving or raising treatment. In addition, in the case of knitted articles, it is preferable for the knitted articles to have raised fibers in pile form, or pile or thread terminals on the surface as a result of raising treatment. Cloth complexes using such woven or knitted articles are particularly appropriate for use when applied to brushes.

In the case where textiles, knitted articles and non-woven cloths are made to adhere to a base, acryl based, urethane based and ester based adhesives, for example, can be used. It is preferable for the thickness of the adhesive to be 1 μm to 500 μm. The adhesive may be used as a single layer, or, if necessary, a number of types of adhesive may be mixed, or a number of layers of the adhesive may be used. In addition, as for the base to which a textile, knitted article or non-woven cloth is attached, an appropriate one can be adopted on the basis of the apparatus in which the cloth complex is to be incorporated, the type of adhesive that is used and the intensity of the magnetic field. As the base, films, sheets, paper, plates, and cloths made of synthetic resins, natural resins, synthetic fibers, natural fibers, woods, minerals or metals are appropriate to be adopted for use. Alternatively, processed bodies of a metal, processed bodies of a synthetic or natural resin, or formed bodies, which are members for each application, may be used as the base. In particular, in order to enhance the affinity with an adhesive as described above, it is preferable for the base to be a sheet made of a synthetic or natural resin, or a metal on which processing for providing hydrophilic properties. In the case where the base has front and rear sides, for example, in the case of films, sheets, paper, plates or cloths, textiles, knitted articles or non-woven cloths can be made to adhere to both sides, the front surface and the rear surface, depending on the application and the purpose, so as to form a cloth complex.

The cloth complex is appropriate for use as an antistatic brush, in accordance with the method for use, or the application.

The fibers can be used as at least a portion or the entirety of clothing. In the case where clothing is made, the occurrence of electrostatic can be prevented during wintertime and at the time of drying, due to its excellent conductivity, and thus, clothing that provides a comfortable feeling when worm is provided. In addition, the excellent conductivity makes it difficult to attract dust, and therefore, the fibers are appropriate for use in dust-proof clothing, such as operation clothing and work clothing for during the manufacture of semiconductors. In this case, it is preferable for one of every several fibers of the wefts and/or warps to be a fiber. In addition, magnetic material particles in spherical form are contained in this clothing, and therefore, as a side effect, the heat conductivity of the fibers is high. Therefore, the fibers can be used as a material which instantly absorbs heat when worm, and makes one feel cold when making contact with it, and as a material which immediately makes the body worm, as soon as one enters a warm room from the cold outside during wintertime, and makes one feel warm.

Textiles and/or knitted articles and/or non-woven cloths in which the fibers are used can be made to adhere to at least a portion or the entirety of a bar, so as to form a brush roller. In the case of textiles, textiles that have raised threads or terminals of the thread on the surface of the textiles as a result of pile weaving or raising treatment are preferably used. In addition, in the case of knitted articles, knitted articles that have raised fibers in pile form, or pile or thread terminals on the surface as a result of raising treatment are preferably used. Bars to which such woven or knitted articles are made to adhere are particularly appropriate for use as brushes.

Textiles and/or knitted articles and/or non-woven cloths which are used herein may be cut into a length that is required for the function of the bar (that is to say, the width of winding), so as to make it. possible for it to adhere to the bar in such a manner that it is wound once, or may be cut into a slit form with a length which is one third to one fiftieth of the length of the bar, so as to make it possible for it to adhere to the bar in such a manner that it is wound in spiral form. As for the adhesive that is used, an appropriate one may be adopted on the basis of the application and the purpose for use, and any of a variety of types, for example, an acryl based, ester based or urethane based adhesive, can be adopted. In addition, if necessary, a conductivity controlling agent, such as conductive carbon black or a metal, and a magnetism controlling agent, such as a metal, including iron, nickel, cobalt and molybdenum, an oxide of these metals, or a mixture of these maybe added to the adhesive. It is preferable for the thickness of the layer of the adhesive to be 1 μm to 500 μm. The adhesive may be used in a single layer, or if necessary, a number of types of adhesive maybe mixed, or a number of layers of the adhesive may be used. Furthermore, a conductivity processing agent layer or a material such as a conductive sheet or a conductive film having a specific resistance of $10^2$ Ω·cm to $10^{10}$ Ω·cm, may be pasted to the adhesive surface of the textiles and/or knitted articles and/or non-woven cloths at a stage before they are attached.

The above described short fibers can be made to adhere to at least a portion or the entirety of a bar, so as to form a brush roller where short, fibers are flocked in the bar. The short fibers used herein may be sprayed with a gas, or a process for electrical flocking may be carried out when the short fibers are made to adhere to the bar and flocked, and it is preferable for the short fibers to be flocked through a process for electrical flocking, so that short fibers that stand approximately straight on the surface of the bar. At this time, the short fibers are made to adhere to the surface of the bar in such a manner that 50% or more of the fibers are in a state where they stand approximately straight at an angle from 10° to 90° (that is, perpendicularly). Short fibers made of other fibers which are different from the fibers may be mixed for use with the short fibers made of the fibers. In addition, as for the adhesive, any of a variety of adhesives, for example, an acryl based, urethane based or ester based adhesive, can be selected on the basis of the application and the purpose. It is preferable for the thickness of the adhesive layer to be 1 μm to 500 μm. The adhesive may be a single layer, or, if necessary, a number of types of adhesive may be mixed, or a number of layers of an adhesive may be used. In addition, it is preferable for the specific resistance value of the brush roller that is formed by attaching the short fibers to at least a portion of the bar and flocking them to be $10^2$ Ω·cm to $10^{11}$ Ω·cm.

As the main material for the core of the above described bar, an appropriate one may be adopted on the basis of the application and the purpose for use, and metals, synthetic resins, natural resins, woods and minerals can be cited. These may be used alone, or a number of types may be combined. In the case where the material is used as a member that is incorporated in an electro-photographic apparatus, it is preferable for the core to be a bar that is made primarily of a metal. Furthermore, in the case where the bar is made of a metal, it is preferable for at least a portion of the metal or the entire surface of the required portion to be covered with an intermediate layer, to which textiles and/or knitted articles and/or non-woven cloths are made to adhere at the top, as described above, or short fibers are made to adhere at the top and flocked. The raw material that is used as this intermediate layer primarily provides cushioning to the bar, or provides auxiliary elasticity or rigidity in case the elasticity or the rigidity of the fibers in brush form is not sufficient. In such a configuration, the toner removing performance in a cleaning apparatus, or toner applying performance in a developing apparatus can be significantly increased. Urethane based materials, elastomer materials, rubber materials and ethylene-vinyl alcohol based materials, for example, are appropriate for use for this intermediate layer. It is preferable for the thickness of the intermediate layer to be 0.05 mm to 10 mm. The intermediate layer may additionally include a conductivity controlling agent or a magnetism controlling agent as described above, if necessary.

A brush roller where textiles and/or knitted articles and/or non-woven cloths are used as at least a portion, as described above, is used by being appropriately incorporated in a cleaning apparatus, in such a manner that the responsiveness to magnetic fields or the conductivity of the fibers is used. Here, it is preferable for the specific resistance value of the brush roller that is incorporated in a cleaning apparatus to be $10^2$ Ω·cm to $10^7$ Ω·cm, and it is more preferable for the specific resistance value to be $10^3$ Ω·cm to $10^7$ Ω·cm. The brush roller captures and removes unnecessary substances while rotating, and, if necessary, while electricity or a magnetic field is being applied in the cleaning apparatus, and such removing performance becomes significantly excellent by setting the specific resistance value within the above described range. In an electro-photographic apparatus, the cleaning apparatus removes unnecessary toner from a photoreceptor. Even in the case where there is a change in the environment, particularly a change in the humidity, within the electro-photographic apparatus when toner is electrically or magnetically removed, the conductance and the very low coercive force of the brush roller are stable. This is because the brush roller uses fibers that contain magnetic material particles in spherical form. That is to say, the brush roller always has stable performance when removing toner from the photoreceptor, and provides an excellent cleaning apparatus. In addition, as for the manner in which a brush roller is used within a cleaning apparatus, the brush roller is used to clean a member for cleaning a photoreceptor (in some cases, as a brush roller as described above, or a member in blade form, as in the prior art), in addition to the manner according to which a brush makes direct contact with a photoreceptor for cleaning, as described above. That is to say, a brush roller may be used to clean the cleaning apparatus, or the brush roller may be used to transfer the collected unnecessary toner to another place. In such a case, a high performance cleaning apparatus is provided as a result. In addition, one or more brush rollers may be used in a cleaning apparatus.

A brush roller where textiles and/or knitted articles and/or non-woven cloths are used as at least a portion in such a manner that they are made to adhere to a bar, or a brush roller where short fibers as those described above are at least partially used in such a manner that they are made to adhere to a bar and flocked, is appropriate for incorporation in a charging apparatus that is used in an electro-photographic apparatus, so that the conductivity of the fibers is used. It is preferable for the specific resistance value of a brush roller that is incorporated in a charging; apparatus to be $10^5$ Ω·cm to $10^{10}$ Ω·cm, and it is more preferable for it to be $10^6$ Ω·cm to $10^9$ Ω·cm. A charging apparatus where a brush roller is used as described above is used by controlling the conductivity (specific resistance value) of the brush roller. At this time, the brush roller can uniformly charge a photoreceptor. Even though in some cases, there is a change in the environment, as described above, within the electro-photographic apparatus, for example, a gradual change in the humidity during the operation of the electro-photographic apparatus, or a change in the humidity due to the changing of seasons, the specific resistance value of the fibers to which magnetic material particles in spherical form have been added, and which is used in the brush roller either does not change or changes very slightly, in spite of the above described change in the humidity. Accordingly, charge spots do not easily occur on the photoreceptor, and as a result, an excellent charging apparatus can be provided, by using a brush roller, as described above.

In addition, even in the case where some toner remains on the surface of the photoreceptor of this electro-photographic apparatus due to insufficient cleaning, this brush roller can also be used as a cleaning roller. Therefore, staining does not occur, or little occurs at the time of developing or printing. Furthermore, in the case where electro-photographic apparatuses are miniaturized, a cleaning apparatus and a charging apparatus can be integrated so that space is saved, instead of being separately installed. In addition, one or more brush rollers as those described above may be used in a charging apparatus.

A brush roller where textiles and/or knitted articles and/or non-woven cloths are used as at least a portion in such a manner that they are made to adhere to a bar, or a brush roller where short fibers as those described above are at least partially used in such a manner that they are made to adhere to a bar and flocked, is appropriate for incorporation in a developing apparatus, so that the responsiveness to magnetic fields and the conductivity of the fibers is used. A developing apparatus in an electro-photographic apparatus converts a latent image that has been produced by a laser on the surface of a photoreceptor that has been uniformly charged by a charging apparatus as that described above into a visible image. As described above, even in the case where there is a change in the humidity within the electro-photographic apparatus, there are no, or almost no spots where the specific resistance value or responsiveness to magnetic fields differ on the brush roller, and therefore, toner is uniformly supplied to the photoreceptor so as to provide a visual image, and the gained image or the printed material includes no, or almost no stains or printing spots, thus providing a very beautiful image. In particular, in the case where toner is magnetic toner or carrier containing toner that includes metal carriers, the developing apparatus is very effective.

A brush roller where textiles and/or knitted articles and/or non-woven cloths are used as at least a portion in such a manner that they are made to adhere to a bar, or a brush roller where short fibers as those described above are at least partially used in such a manner that they are made to adhere to a bar and flocked, is appropriate for incorporation in an anti-electrostatic apparatus that is used in an electro-photographic apparatus, so that the conductivity of the fibers is used. An anti-electrostatic apparatus exhibits excellent antistatic performance when the conductivity (specific resistance value) of the brush roller is small. Therefore, it is preferable for the specific resistance value of the brush roller to be $10^2$ Ω·cm to $10^7$ Ω·cm. In particular, when a brush roller is used in an electro-photographic apparatus, an innumerable amount of fibers on the surface of the brush roller provide stable and uniform anti-electrostatic effects. In addition, it usually becomes possible to enhance the cleaning effects of the above described cleaning apparatus that is provided after the anti-electrostatic apparatus. In addition, in the case where electro-photographic apparatuses are miniaturized, a brush roller can be incorporated both as an anti-electrostatic and cleaning apparatus.

As for the above described electro-photographic apparatus where a cleaning apparatus and/or a charging apparatus and/or a developing apparatus and/or an anti-electrostatic apparatus, a laser beam monochrome printer, a laser beam color printer, a monochrome copier, a color copier, a monochrome or color facsimile, a multifunctional machine and a word processor can be cited as concrete examples. An apparatus for developing or printing by means of a mechanism where a latent image is produced by a laser on a charged photoreceptor and converted to a visible image using toner uses the fibers as described above, and therefore, has stable cleaning, charging, developing and anti-electrostatic performance, irrespectively of any change in the environment, in particular, a change in the humidity within the electro-photographic apparatus. Therefore, gained prints or developed image become very beautiful, particularly in the case of colors where a number of types and a large amount of toner is used, which, of course, includes monochrome. In addition, the length of the fibers and the content of magnetic material particles in spherical form that are contained in the brush roller are optimized, and thereby, more stable cleaning, charging, developing and anti-electrostatic performance can be provided. Therefore, it becomes possible to increase the driving speed of the electro-photographic apparatus, that is to say, to increase the printing or developing speed (the number of images) per hour unit. In addition, further miniaturization, saving of space and conservation of energy can be achieved, as described above, with an electro-photogaphic apparatus in which the fibers are used.

In the following, our findings and methods are described concretely and in detail, using the examples, but the disclosure is not limited to these examples. Property values in the examples are measured in accordance with the following methods.

EXAMPLES

A. Measurement of Melt Viscosity

The melt viscosity was measured at a rate of shearing of 10 $sec^{-1}$ in a nitrogen atmosphere using Capirograph 1B made by Toyo Seiki Seisaku-sho, Ltd. with a barrel diameter of 9.55 mm, a nozzle length of 10 mm and an inner nozzle diameter of 1 mm. The average value of the five measured values was gained as a measured value of the melt viscosity. As for the time for measurement, the five measurements were completed within 30 minutes, in order to prevent the deterioration of samples.

B. Measurement of Glass Transition Temperature (Tg) and Melting Point (Tm)

Tm and Tg were measured using 10 mg of a sample at a rate of increase in temperature of 16° C./min, by a differential scanning calorimeter (DSC-2) made by PerkinElmer, Inc. The definition of Tm and Tg is as follows. First, the temperature ($Tm_1$) at the peak of heat absorption that was observed when measurement was carried out once at a rate of increase in temperature of 16° C./min, and after that, the temperature of approximately ($Tm_1$+20)° C. was held for five minutes. After that, the system was quenched to room temperature (the total of the time for quenching and the time for holding room temperature was five minutes), and measurement was again carried out under conditions where the temperature was increasing at 16° C./min. At this time, the temperature at the peak of heat absorption that was observed as a slide of the base line in step form was gained as Tg, and the temperature at the peak of heat absorption that was measured as the melting temperature of the crystal was gained as Tm.

C. Confirmation of Average Particle Diameter and Form of Magnetic Material Particles in Spherical Form A platinum-palladium vapor deposition (thickness of vapor deposited film: 25 angstrom to 50 angstrom) process was carried out on a sample at a voltage for acceleration of 5 kV, and after that, the average particle diameter and form were confirmed at an arbitrary magnification of between 200 times to 100,000 times, using a scanning electron microscope ESEM-2700, made by Nikon Corporation. As for the average particle diameter and form, an observation photograph was digitally taken and processed with the computer software WinROOF (version 2.3), made by Mitani Corporation, and thus, the average area value of the particles was calculated, and in addition, the average particle diameter of the magnetic material particles in spherical form was calculated from this average area value, under the assumption that the particles were approximately circular. In addition, the maximum diameter (R) and the minimum diameter (r) of each particle was determined with the eye and measured for 50 magnetic material particles in spherical form in the photograph, and the degree of circularity was calculated from the ratio (R/r), and particles having a degree of circularity of no greater than 1.5 were assumed to be in spherical form.

D. Measurement of Elastic Modulus of Incipient Tension, Residual Elongation Percentage and Breaking Intensity of Fibers A tensiron drawing tester (TENSIRON UCT-100), made by Orientec Corporation, was used. The intensity and the residual elongation percentage were measured for non-drawn threads having an initial sample length of 50 mm, at a rate of drawing of 400 mm/min, and for drawn threads having an initial sample length of 200 mm at a rate of drawing of 200 mm/min, respectively, and the average values of five measurements were gained as the respective measured values.

E. Calculation of Ratio of Contraction in Boiling Water at 98° C. for 15 Minutes (Ratio of Contraction in Boiling Water)

Five rings of 1 m of extended threads were bundled and pinched with a clip, and then, the length L1 of the bundle was measured (at this time, the length was approximately 500 mm). Next, this bundle was slowly lowered into boiling water at a temperature of 98° C. and left still for 15 minutes, and after that, taken out and air-dried for 1 or more hours. After having been air-dried, the length L2 of the bundle was again measured. The ratio of contraction (%) was calculated in the following equation:

$$\text{ratio of concentration (\%)}=(L1-L2)/L1\times 100$$

F. Overall Evaluation

The fibers were evaluated in terms of four points: responsiveness to magnetic fields, resistance to heat, mixing properties magnetic material particles in spherical form, and smoothness of processing.

First, concerning responsiveness to magnetic fields, 5 g of short fibers which were gained by cutting the fibers to a length of 5 mm were placed in a plastic bag. Neodymium magnets made by Niroku Seisakusho Co., Ltd. (model name: NE011 (dimensions: outer diameter: 30 ϕmm, height: 15 mm), material: N40, surface magnetic flux density: 490 milli-tesla) were stuck to these short fibers for one minute, so that the short fibers were magnetized, and after that, the neodymium magnets were separated. These short fibers were made to make contact with the metal portion of an electromagnet that was not energized, to confirm whether or not the short fibers were magnetized (became magnets). Short fibers that were not magnetized are indicated by double circles ◎ (excellent), and short fibers that were magnetized are indicated by Δ (inferior).

Concerning the resistance to heat, where the ratio of contraction in boiling water in the above described item E was less than 5%, the fibers are indicated by double circles ◎ (excellent), where the ratio of contraction in boiling water was no less than 5% and less than 10%, the fibers are indicated by ○ (good), and where the ratio of contraction in boiling water was no less than 10%, the fibers are indicated by Δ (inferior).

Concerning the mixing properties with magnetic material particles in spherical form, non-extended threads that were gained through spinning were frozen in liquid nitrogen and bent so as to break (threads were broken with the fibers cracked), and after that, the broken surface was observed with the scanning electron microscope of the above described item C, and the state of aggregation of the magnetic material particles in spherical form was observed. In the case where 5 or more magnetic material particles in spherical form made contact with each other, they were determined to be in a state of aggregation. An arbitrary 5 cross sections which were apart from each other by 1 m or more were observed, and threads where 10 or more aggregations were observed per cross sections on average are indicated by Δ (inferior), and threads where there were less than 10 aggregations or no aggregations are indicated by double circles ◎ (excellent).

Concerning the smoothness of processing, wear of the cutting blade or wear of the guide driving processing after the fibers had been cut and processed was observed with the eye. Where wear was observed after 1 kg of fibers had been cut and processed during processing, the fibers are indicated by Δ (inferior), where wear was observed after 10 kg, which exceeds 1 kg, of fibers had been cut and processed during processing, the fibers are indicated by ○ (good), and where no wear was observed in the cutting blade or in the guide during processing after fibers that exceeded 10 kg had been cut and processed during processing, the fibers are indicated by double circles ◎ (excellent).

From among these four evaluation items, fibers which were evaluated as Δ for any one item were failed, and fibers which were not evaluated as Δ for any of the items were passed. In particular, from among those that were passed, those which were evaluated as double circles ◎ for all of the items were marked as "excellent," and those which were evaluated as ○ for any of the items were marked as "good."

G. Method for Measuring Specific Resistance Values of Fibers and Brush Roller

The atmosphere for measurement was set to a temperature of 23° C. and a humidity of 55% (hereinafter sometimes referred to as normal conditions). Samples to be measured were held in this measurement atmosphere for at least one hour, and after that, the specific resistance values were measured. First, in the case of fibers having a length of no less than 100 mm, the bundle of fibers was prepared as a bundle of 1000 dtex and then cut to a length of 50 mm, and thus, electrodes were attached to the end surfaces, and measurement was carried out. In addition, in the case where the length of fibers was less than 100 mm, a container of an insulator having a length (A) of 10 cm, a width of 2 cm and a depth of 1 cm with electrodes on the two end surfaces of (A) was filled in with the fiber under a pressure of 5 kg/cm$^2$, and the container was sealed, and after that, measurement was carried out so that the specific resistance value could be found, by calculating the specific resistance value per single thread of fiber.

In the case of a brush roller, a brush roller was pressed against a metal plate that was grounded with a load of 500 g, and in this state, a voltage of 1 kV was applied between one end of the bar and the metal plate. The amount of current I (μA) that flowed at this time was measured in order to find 1/I, which is the specific resistance value of the brush roller. In addition, as for the atmospheric conditions in the case where the specific resistance value was measured while the humidity changed, measurement was carried out under three different temperature and conditions, a temperature of 28° C. and a humidity of 85% (high temperature, high humidity conditions), and a temperature of 10° C. and a humidity of 15% (low temperature, low humidity conditions), in addition to the above described normal conditions, and the specific resistance values were found.

H. Measurement of Conductivity of Magnetic Material Particles in Spherical Form

Measurement was carried out at a temperature of 23° C., in accordance with JIS C 2525. Concretely, three test pieces having a thickness of 0.5 mm, a width of 10 mm and a length of 500 mm, which were gained by melting and annealing magnetic material particles in spherical form, were used. The specific resistance values (specific volume resistance) were found for the three test pieces, and the average value of the gained three measured values was assumed to be specific resistance value of these magnetic material particles in spherical form.

I. Measurement of Coercive Force and Saturation Magnetic Flux Density of Magnetic Material Particles in Spherical Form Magnetic material particles in spherical form were melted and annealed so as to fabricate three rings with circular cross sections having an outer diameter of 45 mm, an inner diameter of 33 mm and a thickness of 1 mm, and then, the saturation magnetic flux density and the coercive force were separately found in accordance with JIS C 2504, in the same manner as in the above described H. The average values of the gained values that were each measured three times were assumed to be the saturation magnetic flux density and the coercive force of these magnetic material particles in spherical form.

J. Measurement of Purity of Magnetic Material Particles in Spherical Form

As for the measurement of the purity in the case where a material made of a single metal, such as pure iron, pure nickel, pure cobalt or pure molybdenum, was used for magnetic material particles in spherical form, the used magnetic material particles in spherical form were dissolved in an acid where an equal amount of hydrochloric acid and nitric acid were mixed so as to form a solution having a concentration of 0.1 wt %, and the concentration % in the magnetic material particles in spherical form of Al, Si, Cr, Mn, Fe, Co, Ni, Cu, Zn, Mo and Pb, excluding the element of the used magnetic material particles in spherical form, was found through inductively coupled plasma (ICP) emission spectral analysis, so that the remaining value that could be gained by subtracting this concentration % from 100% was assumed to be the purity of the magnetic material particles in spherical form. In the case (of a mixture) where a number of types of magnetic material particles in spherical form were used, and in the case where the magnetic material particles in spherical form were made of an alloy, ICP emission spectral analysis was carried out on all of the above described elements, so that the ratio of respective component elements could be calculated.

K. Measurement of Fiber Length of Short Fibers

Short fibers having a length of no less than 20 mm were measured using a micrometer caliper while applying a load of 0.1 g/dtex. In addition, in the case of short fibers having a length of less than 20 mm, the length of 50 short fibers was measured under a magnification of 20, using a SHADOW GRAPH Model 6, made by Nippon Kogaku K. K., and the average value thereof was assumed to be the fiber length.

Reference Example 1

Manufacture through Kneading of Polyester to which Magnetic Material Particles in Spherical Form Were Added 0.03 weight parts of a solution of 85% of phosphorous acid, which is a color protecting agent, 0.06 weight parts of antimony trioxide, which is a condensation polymerization catalyst, and 0.06 weight parts of cobalt acetate tetrahydrate, which is a color matching agent, were respectively added to a low polymer that was gained through a conventional ester reaction of 166 weight parts of terephthalic acid and 75 weight parts of ethylene glycol, so that a condensation polymerization reaction occurred, and pellets of poly(ethylene terephthalate) (hereinafter referred to as PET) having an IV of 0.70 and a melt viscosity of 2050 poise (measuring temperature: 290° C., 10 $sec^{-1}$) were gained.

These PET pellets were dried in a vacuum at a temperature of 150° C. for 10 hours, and after that, iron (which is a pure element product having an iron purity of 99.1% and is in spherical powder particle form (of which the degree of circularity was 1.1 or less in the measurements of the above described item C) and of which the code is FEE06PB), made by Kojundo Chemical Laboratory Co., Ltd. was added to melted PET in a nitrogen atmosphere, and the mixture was kneaded using a twin-screw extruder (length of screw L/diameter of screw D=45), so that the mixture of polyethylene terephthalate and iron that was gained after the completion of kneading contained 10 wt %, 40 wt % and 60 wt % of iron. After that, the discharged gut was cut with a cutter, after being cooled with faucet water, and thus, pellets of a mixture of poly(ethylene terephthalate) and iron (hereinafter referred to as PET-Fe1) which contain 10 wt % or iron and have a melt viscosity of 1890 poise (measuring temperature: 290° C., 10 $sec^{-1}$, same in the following), pellets of a mixture of poly (ethylene terephthalate) and iron (hereinafter referred to as PET-Fe2) which contain 40 wt % or iron and have a melt viscosity of 1720 poise, and pellets of a mixture of poly (ethylene terephthalate) and iron (hereinafter referred to as PET-Fe3) which contain 60 wt % or iron and have a melt viscosity of 1580 poise were respectively gained. In all of the pellets, no aggregation was observed, indicating excellent kneadability.

Reference Example 2

Manufacture through Polymerization of Polyester to which Magnetic Material Particles in Spherical Form Were Added Ethylene glycol slurry of pure iron that was gained by adding 10 wt % of iron that is the same as that in Reference Example 1 to ethylene glycol was added as magnetic material particles in spherical form to a low polymer that was gained through a conventional ester reaction of 166 weight parts of terephthalic acid and 75 weight parts of ethylene glycol, and after that, 0.03 weight parts of a solution of 85% of phosphorous acid, which is a color protecting agent, 0.06 weight parts of antimony trioxide, which is a condensation polymerization catalyst, and 0.06 weight parts of cobalt acetate tetrahydrate, which is a color matching agent, were respectively added, so that a condensation polymerization reaction occurred. The condensation polymerization reaction was completed with polymerization agitate torque that is approximately the same as that for poly(ethylene terephthalate) in Reference Example 1, and pellets of a mixture of poly(ethylene terephthalate) and iron (hereinafter referred to as PET-Fe4) which have a melt viscosity of 1520 poise (measuring temperature: 290° C., 10 $sec^{-1}$) were gained. In the gained pellets, no aggregation of iron was observed, indicating excellent kneadability.

Example 1

Melt spinning was carried out on the PET-Fe3 of Reference Example 1 using a pressure melting type melt spinning machine. Melt spinning was carried out at a spinning temperature of 290° C., by installing a mouthpiece having 24 holes in round shape with a hole diameter of 0.3 mm, and a filter where the mesh of the filter layer was 20 μ. A non-water containing type treating agent was made to adhere to the discharged fibers, so that the attached amount became 1 wt %, and after that, they were taken up at a taking up velocity of 600 m/min, so that multi-filaments, which are 1590 dtex-24 filaments, of which the cross sectional form is round were gained. No thread breaking occurred during spinning, indicating excellent spinnability.

When the gained multi-filaments were drawn, the thread feeding rate of a thread feeding roller was 100 m/min, the thread feeding rate of a first roller at 90° C. was 100 m/min, the thread feeding rate of a second roller at 140° C. was 450 m/min, and the thread feeding rate of a third roller at 200° C. was 500 m/min, and the fibers were drawn in two stages (between the first and second roller, and between the second and third roller), heat treatment was carried out (the third roller), and after that, the threads were wound after being cooled to a temperature that is no higher than Tg of polyester by a cooling roller. Though winding of a single thread around a roller occurred at a frequency of 0.5 times/kg, drawing properties were excellent. In addition, wear of the cutting blade was observed after 5 kg of drawn thread had been cut and processed, and thus, it was found that the smoothness of processing was excellent. The properties of the threads are shown in Table 1.

TABLE 1

| Item | | (Unit) | Example 1 | Comparison Example 1 | Example 2 | Example 3 | Example 4 | Example 5 |
|---|---|---|---|---|---|---|---|---|
| Fiber forming base polymer | Type (single component) | — | PET | PET | PET | — | — | — |
| | Type (core) | — | — | — | — | PET | PET | Ny6 |
| | Type (sheath) | — | — | — | — | PET | PET | PET-IS |
| Magnetic material particles in spherical form | Type (single component) | — | Pure iron | Ferrite | Pure iron | — | — | — |
| | Type (magnetic layer) | — | — | — | — | Pure iron | Pure iron | Pure iron |
| | Type (protective layer) | — | — | — | — | — | — | — |

TABLE 1-continued

| | | | | | | | | |
|---|---|---|---|---|---|---|---|---|
| | Content | wt %*1 | 60 | 60 | 40 | 60/0 | 60/0 | 60/0 |
| | Form | — | Sphere | Aspherical | Sphere | Sphere | Sphere | Sphere |
| | Purity | % | 99.1 | — | 99.4 | 99.1 | 99.1 | 99.1 |
| | Average particle diameter | μm | 2.5 | 1.7 | 10.8 | 2.5 | 2.5 | 2.5 |
| | Specific resistance value | μΩ · cm | 9.8 | $10^{11.8}$ | 10.2 | 9.8 | 9.8 | 9.8 |
| | Coercive force | A/m | 4.0 | 2100 | 4.0 | 4.0 | 4.0 | 4.0 |
| | Saturation magnetic flux density | T (tesla) | 2.15 | 0.335 | 2.15 | 2.15 | 2.15 | 2.15 |
| Properties of fibers | Type of complex | — | Single component | Single component | Single component | Bimetal | Core and sheath | Core and sheath |
| | Core component | — | — | — | — | — | Magnetic layer | Magnetic layer |
| | Ratio of complex | Magneticlayer/ protective layer | — | — | — | 60/40 | 80/20 | 80/20 |
| | Ratio of contraction in boiling water | % | 2.3 | 3.1 | 2.7 | 2.6 | 2.2 | 4.5 |
| | Residual elongation percentage | % | 11 | 5 | 21 | 14 | 18 | 25 |
| | Elastic modulus of incipient tension | cN/dtex | 18 | 13 | 12 | 20 | 25 | 15 |
| Overall evaluation | Responsiveness to magnetic fields | ◎ or Δ | ◎ | Δ | ◎ | ◎ | ◎ | ◎ |
| | Resistance to heat | ◎ or ○ or Δ | ◎ | ◎ | ◎ | ◎ | ◎ | ◎ |
| | Mixability with soft magnetic material | ◎ or Δ | ◎ | Δ | ○ | ◎ | ◎ | ◎ |
| | Smoothness of processing | ◎ or ○ or Δ | ○ | Δ | ○ | ◎ | ◎ | ◎ |
| | Overall determination | Pass or fail | Pass "good" | Fail | Pass "good" | Pass "excellent" | Pass "excellent" | Pass "excellent" |

| | Item | (Unit) | Example 6 | Example 7 | Example 8 | Example 9 | Example 10 |
|---|---|---|---|---|---|---|---|
| Fiber forming base polymer | Type (single component) | — | — | — | — | — | — |
| | Type (core) | — | PET | PET | PET | PET | PET-I |
| | Type (sheath) | — | PET | PET | PET | PET | PE |
| Magnetic material particles in spherical form | Type (single component) | — | — | — | — | — | — |
| | Type (magnetic layer) | — | Pure iron | Pure iron | Pure iron | Pure iron | Pure nickel |
| | Type (protective layer) | — | Pure iron | — | Pure iron | — | — |
| | Content | wt %*1 | 60/10 | 40/0 | 40/10 | 60/0 | 60/0 |
| | Form | — | Sphere | Sphere | Sphere | Sphere | Sphere |
| | Purity | % | 99.1 | 99.1 | 99.1 | 99.1 | 99.2 |
| | Average particle diameter | μm | 2.5 | 2.5 | 2.5 | 2.5 | 2.7 |
| | Specific resistance value | μΩ · cm | 9.8 | 9.8 | 9.8 | 9.8 | 8.1 |
| | Coercive force | A/m | 4.0 | 4.0 | 4.0 | 4.0 | 0.7 |
| | Saturation magnetic flux density | T (tesla) | 2.15 | 2.15 | 2.15 | 2.15 | 0.61 |
| Properties of fibers | Type of complex | — | Core and sheath | Core and sheath | Core and sheath | Core and sheath | Core and sheath |
| | Core component | — | Magnetic layer | Magnetic layer | Magnetic layer | Protective layer | Protective layer |
| | Ratio of complex | Magneticlayer/ protective layer | 80/20 | 80/20 | 80/20 | 80/20 | 80/20 |
| | Ratio of contraction in boiling water | % | 1.8 | 4.2 | 3.3 | 2.0 | 4.0 |
| | Residual elongation percentage | % | 10 | 18 | 16 | 12 | 15 |
| | Elastic modulus of incipient tension | cN/dtex | 20 | 25 | 23 | 18 | 13 |
| Overall evaluation | Responsiveness to magnetic fields | ◎ or Δ | ◎ | ◎ | ◎ | ◎ | ◎ |
| | Resistance to heat | ◎ or ○ or Δ | ◎ | ◎ | ◎ | ◎ | ◎ |
| | Mixability with soft magnetic material | ◎ or Δ | ◎ | ◎ | ◎ | ◎ | ◎ |
| | Smoothness of processing | ◎ or ○ or Δ | ◎ | ◎ | ◎ | ○ | ◎ |
| | Overall determination | Pass or fail | Pass "excellent" | Pass "excellent" | Pass "excellent" | Pass "good" | Pass "excellent" |

PET: polyethylene terephthalate, Ny6: nylon 6, PET-IS: PET where isophthalic acid and sulfo sodium isophthalate are copolymerized, PET-I: polyethylene terephthalate copolymerized with isophthalic acid, PE: polyethylene made by Mitsui Chemicals, Inc.

*1Description of content of soft magnetic material: content in fibers is described in the case of fibers of single component. (content of soft magnetic material in magnetic layers)/(content of soft protective material in magnetic layers) is described in the case of complex threads.

Comparison Example 1

60 wt % of soft ferrite particles made by Toda Kogyo Corporation (type KNS-415, which are particles manufactured through grinding, had an average degree of circularity of 1.8, according to the measurement of the above described item C, and have an innumerable number of protrusions and recesses having a size as large as one tenth or more of the particle diameters on the surface of the particles, and thus, are not perceived as having spherical forms) was added instead of iron in Reference Example 1, and the mixture was kneaded, in the same manner as in Reference Example 1. It seemed that the wettability of the particles with the polymer was poor, or the particles were not packed in closest packing manner, and therefore, the kneadability was poor, and an innumerable number of aggregations were observed. Melt spinning was carried out on the gained mixture in accordance with the same method as that of Example 1. Thread breaking during spinning occurred at a frequency of 15.5 times/kg, and pressure loss in the flow path within the spinning machine rose, and thus, spinnability was poor. In addition, the gained multi-filaments were drawn in the same method as that of Example 1. Single thread breaking during drawing occurred at a frequency of 10.3 times/kg, and a great amount of wear of the cutting blade was observed after 0.5 kg of fibers had been processed during the cutting process of the fibers, and wear of the guide during the process was also observed, indicating poor smoothness of processing. The properties of the threads are shown in Table 1.

Example 2

40 wt % of powder particles of iron made by Kojundo Chemical Laboratory Co., Ltd. (which is a pure element product having an iron purity of 99% or more, and is in spherical powder particle form having an average particle diameter of 10.8 μm (the degree of circularity was no greater than 1.1 according to the measurement of the above described item C), and of which the code is FEE10PB) was added in Reference Example 1, and the mixture was kneaded, in the same manner as in Reference Example 1. The kneadability was excellent. Melt spinning was carried out on the gained mixture in accordance with the same method as that of Example 1. Though thread breaking during spinning occurred at a frequency of 1.3 times/kg, the spinnability was excellent. The gained multi-filaments were drawn according to the same method as that of Example 1. Though winding of a single thread during drawing occurred at a frequency of 2.1 times/kg, the expandability was excellent. In addition, though wear of the cutting blade and wear of the guide was observed after 4.2 kg of the fibers had been cut during the cutting process of the fibers, the smoothness of processing was excellent. The properties of the threads are shown in Table 1.

Example 3

When bimetal type melt spinning was carried out in an extruder type complex melt spinning machine with two single-screw extruders, PET-Fe3 of Reference Example 1 was used for magnetic layers, and PET of Reference Example 1 was used for protective layers, respectively. Bimetal type complex spinning was carried out at a complex ratio of magnetic layers: protective layers=6: 4, under the same conditions as those of Example 1, for other parts, so that bimetal multi-filaments, which are 1144 dtex-24 filaments, of which the cross sectional form was approximately round could be gained. No thread breaking occurred during spinning, indicating good spinnability.

The gained multi-filaments were drawn in accordance with the same method as that of Example 1. No thread cutting occurred during drawing, indicating excellent drawability. In addition, no wear of the cutting blade or of the guide during processing was observed, indicating excellent smoothness of processing. The properties of the threads are shown in Table 1.

Example 4

When core and sheath type melt spinning was carried out in the complex melt spinning machine of Example 3, PET-Fe4 of Reference Example 2 was used for magnetic layers, and PET of Reference Example 1 was used for protective layers, respectively, and core and sheath type complex spinning was carried out with magnetic layers as cores and protective layers as sheaths having a complex ratio of magnetic layers: protective layers=8: 2, under the same conditions as in Example 1, except for other parts, so that core and sheath multi-filaments, which are 1330 dtex-24 filaments, of which the cross sectional form was round could be gained. No thread breaking during spinning occurred, indicating excellent spinnability.

The gained multi-filaments were drawn according to the same method as that of Example 1. No winding of single threads or thread cutting occurred during drawing, indicating excellent drawability. In addition, no wear of the cutting blade or no wear of guide during the processing was observed, indicating excellent smoothness of processing. The properties of the threads are shown in Table 1.

Example 5

A nylon 6 resin "Amiran" (registered trademark) (type CM1017) made by Toray Industries, Inc. was used instead of PET in Reference Example 1, and pellets of a mixture of nylon 6 and iron (hereinafter referred to as Ny6-Fe3), which contain 60 wt % of iron and have a melt viscosity of 2530 poise (measuring temperature: 260° C., 10 sec−1) were gained according to the same method as that of Reference Example 1, except that iron was added and the mixture was kneaded so that iron in the mixture became 60 wt %.

In addition, when core and sheath type complex spinning was carried out according to the same method as that of Example 4, the above described Ny6-Fe3 was used for magnetic layers, and a copolymerized poly(ethylene terephthalate) (hereinafter referred to as PET-IS, IV: 0.55) where 5 mol % of isophthalic acid and 5 mol % of sodium sulfonate derivative of isophthalic acid are copolymerized was used for protective layers, and core and sheath type complex spinning was carried out at a spinning temperature of 280° C., under the same conditions as those in Example 1 for other parts, so that core and sheath multi-filaments, which are 1180 dtex-24 filaments, of which the cross sectional form is round were gained. No thread breaking occurred during spinning, indicating excellent spinnability.

The gained multi-filaments were drawn according to the same method as that of Example 1. No winding of single threads or thread breaking occurred during drawing, indicating excellent drawability. In addition, no wear of the cutting blade or of the guide during processing was observed, indicating excellent smoothness of processing. The properties of the threads are shown in Table 1.

Examples 6 to 9

When core and sheath complex spinning was carried out in the same manner as in Example 4, materials for magnetic layers and for protective layers which were respectively prepared in Example 1, were combined as shown in Table 1, and spun. Concretely, in Example 6, PET-Fe3, which was used for magnetic layers of cores, and PET-Fe1, which was used for protective layers of sheaths, were combined. In Example, 7, PET-Fe2, which was used for magnetic layers of cores, and PET to which pure iron had not been added, and which was used for protective layers of sheaths, were combined. In Example 8, PET-Fe2, which was used for magnetic layers of cores, and PET-Fe1, which was used for protective layers of sheaths, were combined. In Example 9, PET-Fe3, which was used for magnetic layers of sheaths, and PET, which was used for protective layers of cores, were combined. As for the spinning conditions and drawing conditions, the same method was used as that of Example 4. Only in Example 9 was wear of the cutting blade observed after 9 kg of the fibers had been processed during cutting processing, but the smoothness of processing was excellent. The properties of the gained drawn threads are shown in Table 1.

Example 10

A copolymerized poly(ethylene terephthalate) (PET-I, IV: 0.70) where PET of Reference Example 1 and 15 mol % of isophthalic acid were copolymerized was used instead of PET, and nickel made by Kojundo Chemical Laboratory Co., Ltd. (which is a pure element product having a nickel purity of 99% or more in spherical powder particle form having an average particle diameter of 2.7 μm (the degree of circularity was no greater than 1.1 according to the measurements of the above described item C) and of which the code is NIE02PB) was used instead of iron in Reference Example 1, and pellets of a mixture of PET-I and nickel (hereinafter referred to as PET-I-Ni) which contain 60 wt % of nickel and a melt viscosity of 1850 poise (measuring temperature: 290° C., 10 $sec^{-1}$) according to the same method as that of Reference Example 1, except for the above.

In addition, when core and sheath type complex spinning was carried out in accordance with the same method as that of Example 4, the above described PET-I-Ni was used for magnetic layers, and high density polyethylene (HI-ZEX (registered trademark), 7000F) made by Mitsui Chemicals, Inc. was used for protective layers, and core and sheath type complex spinning was carried out at a spinning temperature of 290° C. under the same conditions as those of Example 1 for other parts, so that core and sheath multi-filaments, which are 1090 dtex-24 filaments, of which the cross sectional form is round were gained. No thread breaking occurred during spinning, indicating excellent spinnability.

The gained multi-filaments were drawn according to the same method as that of Example 1. No winding of single threads or thread breaking occurred during drawing, indicating excellent drawability. In addition, no wear of the cutting blade or of the guide during processing was observed, indicating excellent smoothness of processing. The properties of the threads are shown in Table 1.

Example 11

The fibers that were gained in Examples 4 and 5 were cut into short fibers having a length of 0.5 mm, 1.0 mm, 2.0 mm and 4.0 mm, respectively, and after that, were treated with colloidal silica "Snowtex OS" (registered trademark), made by Nissan Chemical Industries, Ltd., and the specific resistance values of the fibers were adjusted.

Using the gained short fibers, acrylic acid ester based adhesive DICNAL K-1500 (2 wt % of DICNAL VS-20 was added as a thickening agent to 100 wt % of K-1500, hereinafter sometimes referred to as "adhesive A"), made by Dainippon Ink and Chemicals, Inc., was applied to one side of a polyester film "Lumilar" (registered trademark), made by Toray Industries, Inc., so as to have a thickness of approximately 100 μm. Next, electric flocking processing was carried out on the side of the film to which the adhesive was applied, so as to fabricate the flocked matter (A1 to A8). The state of flocking (degree of success of flocking) was evaluated in four stages, approximately standing straight (double circle ◎), some lying fibers observed (○), approximately half of the fibers lying (Δ) and only a small amount of fibers standing straight (x), through visual determination. The results are shown in Table 2.

TABLE 2

| Item | (Unit) | Example 4 | | | | Example 5 | | | |
|---|---|---|---|---|---|---|---|---|---|
| Fiber length | mm | 0.51 | 1.02 | 1.98 | 4.03 | 0.49 | 1.01 | 2.01 | 4.01 |
| Specific resistance value *1 | Ω · cm (×$10^6$) | 310 | 208 | 114 | 71 | 523 | 198 | 134 | 99 |
| Responsiveness to magnetic fields *2 | ○ or Δ | Δ | ○ | ○ | ○ | Δ | ○ | ○ | ○ |
| Name of sample of flocked product | | A1 | A2 | A3 | A4 | A5 | A6 | A7 | A8 |

*1 Specific resistance value: specific resistance value of short fibers on which colloidal silica processing has been carried out.

*2 Responsiveness to magnetic fields: fibers where rigidity increased at the time of application of a magnetic field, confirmed by feeling the material, are indicated by ○, and fibers where there was no clear increase in rigidity are indicated by Δ.

In addition, a magnet brought to the rear side (side which was not flocked) of the fabricated flocked matter, and whether or not the flocked fibers became rigid due to the magnetic field (responsiveness to magnetic fields) was determined by feeling the fibers. The fibers where rigidity increased are marked with ○, and the fibers where there was no clear increase in rigidity are marked with Δ.

In addition, a pile weave and a single tricot knitted article were fabricated from the fibers that were gained in Examples 4 and 5, respectively, and raising treatment was carried out separately on these items. The gained weave and knitted article were made to adhere to the above described polyester film with adhesive A, in the same manner as described above, so as to fabricate cloth complex B and cloth complex C, respectively. Responsiveness to magnetic fields was confirmed in the same manner as described above, and it was found that the rigidity increased in both cloth complexes B and C, indicating excellent responsiveness to magnetic fields (marked with ○).

Example 12

Four types of short fibers (respective length of fibers: 0.51 mm, 1.02 mm, 1.98 mm and 4.03 mm) gained in Example 11 were electrically flocked to bar A (bar made solely of metal) and bar B (metal bar covered with a middle layer made of urethane to which 5% of conductive carbon black was added (thickness: 1.5 mm), respectively, leaving 2 cm of an end portion of the metal bar) with adhesive A of Example 11. Short fibers that failed to adhere were wiped away from the bars, and thus, brush rollers were gained (brush rollers with bar A are referred to as brush rollers A1, A2, A3 and A4, in the order from that having the shortest fiber length, and in the same manner, brush rollers with bar B are referred to as brush rollers B1, B2, B3 and B4). In addition, the pile weave of Example 11 was made to adhere to bar B and flocked, so as to gain brush roller C. The specific resistance value of brush roller A2 with bar A having a fiber length of 1.02 mm and Brush roller B2 with bar B having a fiber length of 1.02 mm under normal conditions was $10^{5.1}$ Ω·cm and $10^{7.6}$ Ω·cm, respectively. In addition, the change in the specific resistance value of brush roller B2 caused by a change in the humidity was measured as $10^{6.6}$ Ω·cm (high temperature, high humidity) $-10^{7.6}$ Ω·cm (normal conditions) $-10^{7.6}$ Ω·cm (low temperature, low humidity). As described above, the change in the specific resistance value of the brush rollers that use the fibers, caused by a change in the humidity, was as small as in the single digits. In addition, the change in the specific resistance value of brush roller C was measured in the same manner, and it was found that the change in the specific resistance value, caused by a change in the humidity, was $10^{6.1}$ Ω·cm (high temperature, high humidity) $-10^{7.0}$ Ω·cm (normal conditions) $-10^{7.1}$ Ω·cm (low temperature, low humidity), which is as small as in the single digits, as in brush roller B2.

Example 13

Brush roller A2 gained in Example 12 was incorporated into an anti-electrostatic apparatus and a cleaning apparatus, and brush roller B was incorporated into a charging apparatus, respectively. Printing was carried out (10 sheets were printed and discharged per minute) continuously for a long period of time by a monochrome laser printer in which the apparatuses were provided, and the printing performance was confirmed, together with a change in the humidity within the printer. The humidity within the printer was lowered to 22% from an initial 62% after approximately 1000 sheets were printed after the start, and was lowered to 18% after approximately 10,000 sheets were additionally printed. However, even after more than 20,000 sheets were printer, the clarity of the printing and the toner cleaning performance were excellent. In addition, the same examination was carried out after replacing brush roller C with brush roller B2, and it was found that the clarity of printing and the toner cleaning performance were excellent even after more than 30,000 sheets were printed.

Example 14

Two types of weaves were fabricated using the fibers gained in Example 4. One was a plain weave fabric where the fibers gained in Example 4 were used as wefts, and polyester fibers which were made of only the polyester of Reference Example 1 and had the same fiber diameter as the fibers gained in Example 4 were used as wefts, and a dress shirt was tailored using this plain weave fabric (clothing 1). The other was a plain weave fabric where the fibers gained in Example 4 were used for all of the warps and wefts, and a dress shirt was tailored (clothing 2). A wearing test was conducted with 10 randomly selected men, and all of them claimed that the shirt "makes for a cold feeling when wearing (cold feeling when making contact)" for both clothing 1 and clothing 2, and in addition, claimed that "clothing 2 makes for a cold feeling when making contact, stronger than clothing 1."

INDUSTRIAL APPLICABILITY

Textiles where the fibers are at least partially used use fibers having excellent responsiveness to magnetic fields and excellent conductivity, as described above. Accordingly, such textiles have conductivity and performance that can release electricity (in other words, anti-electrostatic properties), even in the case where the fibers are only partially used in the textile, in addition to the case where the fibers are used for the entirety of the textile. Therefore, such textiles are excellent for use in a variety of interior materials, such as drapes and curtains, seats for vehicles such as automobiles, trains and airplanes where static electricity tends to easily be generated in human bodies, wall materials and carpets, as well as bedding goods, such as futons, blankets and sheets.

Knitted articles where the fibers are at least partially used have responsiveness to magnetic fields, conductivity and anti-electrostatic performance, in the same manner as the above described textiles. Therefore, these knitted articles are excellent for use in a variety of interior materials, such as wall materials for buildings, tapestry and rugs, seats for vehicles such as automobiles, trains and airplanes, wall materials, carpets, seats for vehicles and car mats, as well as bedding goods, such as futons, blankets and sheets.

Non-woven cloths where the fibers are at least partially used have responsiveness to magnetic fields, conductivity and anti-electrostatic properties, in the same manner as the above described textiles and knitted articles. Therefore, such non-woven cloths can be used as materials in the same applications as the above described textiles and knitted articles, and in addition, are excellent for wider use, including applications where materials need to be thick, for example, in materials for partitions, packages, and materials for peripheral members, such as cushions, of apparatuses and rooms where the occurrence of static electricity is not acceptable.

Clothing where the fibers are at least partially used use fibers having excellent responsiveness to magnetic fields and excellent conductivity, and therefore, the occurrence of static electricity can be prevented when worn, and electricity can be released to the outside of the body. In particular, the fibers are useful in the case where they are used for work clothing in the semiconductor industry, where the occurrence of static electricity is not acceptable, and for dustproof clothing, because it is difficult for static electricity to occur, making it possible to keep off dust. In addition, magnetic material particles in spherical form having excellent thermal conductivity are used in the fibers, and therefore, the fibers can be used for clothing which can release heat to the outside of the body and gives a cool feeling when making contact, and conversely, clothing which can immediately take heat into a cold body from the outside of the body, and gives a warm feeling when making contact. The fibers are appropriate for use, for example, in sports clothing (golf wear and uniforms for gate ball, baseball, tennis, soccer, table tennis, volleyball, basketball, rugby, American football, hockey, track and field, triathlon, speed skating and ice hockey), clothing for infants, ladies and seniors, in addition to outdoor clothing (shoes, bags, supporters, socks and mountain climbing gear), where these functions of giving a cool feeling or a warm feeling when making contact are required.

Brush rollers where textiles and/or knitted articles and/or non-woven cloths, as described above, are at least partially used or attached have fibers having responsiveness to magnetic fields and conductivity as at least a portion thereof, and therefore, are excellent in their function of efficiently removing unnecessary substances or providing required substances by using electrical or magnetic effects.

Brush rollers where short fibers as those described above are used have fibers having responsiveness to magnetic fields and conductivity as at least a portion thereof, and therefore, have a function of efficiently removing unnecessary substances or providing required substances by using electrical or magnetic effects, in the same manner as described above. In addition to this, the brush rollers are excellent for controlling the fiber flocking density of the brush rollers, by controlling the fiber length of the short fibers, and for easily controlling the performance of the brush rollers in terms of removing or providing substances, as described above, on the basis of the purpose. In particular, in the case where the flocked bar is made primarily of a metal, it is possible to control the conductivity (specific resistance value) of the brush rollers, by controlling the conductivity of the magnetic material particles in spherical form in the fibers. Furthermore, in the case where the bar is made of a metal and an intermediate layer that at least partially covert the metal, cushioning can be provided by controlling the material and the thickness of the intermediate layer, and therefore, the brush rollers are excellent when the performance of removing or providing substances as described above is significantly increased.

Cleaning apparatuses where brush rollers, as described above, are used are excellent in the performance of removing substances, because brush rollers rotate, and thereby, unnecessary substances are removed and cleaned. Even in the case where there is a change in the environment, particularly, a change in the humidity, within an electro-photographic apparatus, as described below, for example, when toner is magnetically or electrically removed, the conductivity of the brush roller does not fluctuate, and the brush roller is excellent in that it always has stable performance of removing substances, because it contains magnetic material particles in spherical form having very low coercive force. In addition, the above described brush rollers make direct contact with substances that become an object (for example, photosensitive bodies in the below described electro-photographic apparatus) to perform cleaning in the cleaning apparatus. Furthermore, the above described brush rollers can clean the cleaning apparatus by removing unnecessary substances from other members that perform cleaning. That is to say, the brush rollers are useful as members for cleaning the cleaning apparatus, and as a result, provide a high performance cleaning apparatus.

Charging apparatuses using brush rollers, as described above, are used by controlling conductivity (specific resistance value) of the brush rollers. When a brush roller is used to uniformly charge a photoreceptor in, for example, the below described electro-photographic apparatus, the brush roller is excellent, because it can uniformly charge the photoreceptor. In addition, the specific resistance value of the brush roller either does not change or changes very little, even when there is a change in the environment within the electro-photographic apparatus, for example, a change in the humidity caused by operation of the electro-photographic apparatus or by a change in the seasons. Accordingly, charging spots do not easily appear on the photoreceptor, and thus, an excellent charging apparatus can be provided. In addition, even in the case where some toner remains on the above described photoreceptor of the electro-photographic apparatus due to insufficient cleaning, the brush roller can also function as a cleaning roller, and therefore, the electro-photographic apparatus is excellent in that there are no stains or almost no stains when developing or printing. Furthermore, in the case where the electro-photographic apparatus is miniaturized, it can be miniaturized in an excellent manner, because the cleaning apparatus and the charging apparatus are not individually installed, but rather, integrated into a single cleaning and charging apparatus, which is made possible by using the above described brush roller.

Developing apparatuses using brush rollers, as described above, are used in order to gain effects, by using the specific resistance value of the brush rollers and the responsiveness to magnetic fields of the fibers, in the same manner as in the above described charging apparatuses. When toner is attached to an electrostatic latent image that has been produced on the photoreceptor of the below described electro-photographic apparatus, for example, there are no spots, or almost no spots, on the brush roller made of the fibers, where the specific resistance value or responsiveness to magnetic fields is different, even in the case where there is a change in the environment, such as a change in the humidity, as described above. Accordingly, the toner is uniformly supplied to the photoreceptor so as to make the image visible, and the gained developed material or printed material is very beautiful, without any stains or with almost no stains, and thus an excellent developing apparatus is provided.

Anti-electrostatic apparatuses where brush rollers, as described above, are used are useful for providing a brush roller having excellent anti-electrostatic performance by controlling the amount of magnetic material particles in spherical form that is contained in the fibers so as to decrease the conductivity (specific resistance value) of the brush roller. In particular, when used in the below describe electro-photographic apparatus, a brush roller made of innumerable hairs (fibers) has stable and uniform anti-electrostatic effects, and therefore, it is possible to further enhance cleaning effects in a cleaning apparatus as that described above, that is installed after the anti-electrostatic apparatus. In addition, in the case where the electro-photographic apparatus is miniaturized, the anti-electrostatic apparatus and the cleaning apparatus are integrated before being assembled into the electro-photographic apparatus, by using the brush roller, and thus, an excellent electro-photographic apparatus can be provided.

Electro-photographic apparatuses using cleaning apparatuses and/or charging apparatuses and/or developing apparatuses and/or anti-electrostatic apparatuses, as described above, concretely, apparatuses for developing or printing through a mechanism where a latent image is produced on a charged photoreceptor by means of a laser and made visible using toner, such as laser printers, copiers, facsimiles, multifunctional machines and word processors, have, as described above, Stable cleaning, charging, developing and anti-electrostatic performance, irrespectively of any change in the environment within the electro-photographic apparatus, and therefore, the gained printed or developed materials become very beautiful. In addition, the fiber length and the amount of magnetic material particles in spherical form contained in the above described brush rollers is optimized, so as to provide stable cleaning, charging, developing and anti-electrostatic performance, and therefore, it becomes possible to increase the driving speed of the electro-photographic apparatus, that is to say, increase the rate of printing or developing (number of sheets) per hour unit, which is preferable.

The invention claimed is:

1. Fibers comprising A) a polymer having fiber forming functions; and B) magnetic material particles in spherical form having a saturation magnetic flux density of no less than 0.5 tesla and made of at least one metal selected from the group consisting of iron, nickel and cobalt having a purity of no less than 98% contained in the polymer, wherein the fibers are core and sheath complex fibers comprising magnetic layers made of a core component and containing 20 wt% to 90 wt% of the magnetic material particles in spherical form, and protective layers made of a sheath component and containing less than 20 wt% of the magnetic material particles in spherical form.

2. The fibers according to claim 1, wherein the average particle diameter of the magnetic material particles in spherical form is no greater than 5 μm.

3. The fibers according to claim 1, wherein the coercive force of the magnetic material particles in spherical form is no greater than 1000 A/m.

4. The fibers according to claim 1, wherein the magnetic layers range from 5 vol % to 95 vol %.

5. The fibers according to claim 1, wherein the polymer having fiber forming functions is a polymer selected from the group consisting of polyester based polymers, polyamide based polymers, polyolefin based polymers and polyacrylonitrile based polymers, of which the melting point is no lower than 150° C.

6. The fibers according to claim 1, wherein the specific resistance value is $10^3$ Ω·cm to $10^9$ Ω·cm.

7. Short fibers made of the fibers according to claim 1, wherein the fiber length is 0.05 mm to 150 mm.

8. A textile comprising the fibers according to claim 1.

9. A knitted article comprising the fibers according to claim 1.

10. A non-woven cloth comprising the fibers according to claim 1.

11. A flocked matter, wherein the short fibers according to claim 1 are made to adhere to at least a portion of a base and flocked.

12. A cloth complex comprising a cloth which comprises the fibers according to claim 1, wherein the cloth is selected from the group consisting of the textiles, the knitted articles and the non-woven cloths, and the cloth is made to adhere to at least a portion of a base.

13. Clothing comprising the fibers according to claim 1.

14. A brush roller comprising a cloth which comprises the fibers according to claim 1, wherein the cloth is selected from the group consisting of the textiles, the knitted articles and the non-woven cloths, and at least a portion of the cloth is made to adhere to a bar.

15. A brush roller, wherein the short fibers according to claim 1 are made to adhere to at least a portion of a bar and flocked.

16. A cleaning apparatus, wherein the brush roller according to claim 14 is contained.

17. A charging apparatus, wherein the brush roller according to claim 14 is contained.

18. A developing apparatus, wherein the brush roller according to claim 14 is contained.

19. An antistatic apparatus, wherein the brush roller according to claim 14 is contained.

20. An electro-photographic apparatus comprising the brush roller according to claim 14.

* * * * *